US006237583B1

(12) United States Patent
Ripley et al.

(10) Patent No.: US 6,237,583 B1
(45) Date of Patent: May 29, 2001

(54) BASEBALL PITCHING DEVICE

(75) Inventors: Richard W. Ripley, 31626 Erie Rd., Coarsegold, CA (US) 93614; James E. Flynn, Coarsegold, CA (US)

(73) Assignee: Richard W. Ripley

( * ) Notice: Subject to any disclaimer, the term of this patent is extended or adjusted under 35 U.S.C. 154(b) by 0 days.

(21) Appl. No.: 09/654,437

(22) Filed: Sep. 1, 2000

(51) Int. Cl.[7] ..... F41B 4/00
(52) U.S. Cl. ..... 124/78
(58) Field of Search ..... 124/6, 78

(56) References Cited

U.S. PATENT DOCUMENTS 4,561,414 * 12/1985 Nozato ..... 124/78
5,437,261 * 8/1995 Paulson et al. ..... 124/78
5,464,208 * 11/1995 Pierce ..... 124/78 X
5,964,209 * 10/1999 Boehner ..... 124/78

* cited by examiner

*Primary Examiner*—John A. Ricci
(74) *Attorney, Agent, or Firm*—Christopher J. Whewell

(57) ABSTRACT

Provided herein is a device useful for delivering spherical projectiles to a desired location. The projectiles may comprise baseballs, tennis balls, or the like, and may be conferred with various degrees of linear velocities, spin, and rotational characteristics for their flight. A device according to the invention is especially well suited for use in providing batters with a source of various pre-selected or random pitches of balls, to enhance batting practice in the absence of a human pitcher. A device according to the invention is readily compactable, portable, and efficient with regard to the amount of space it occupies.

47 Claims, 13 Drawing Sheets

BASEBALL PITCHING DEVICE

TECHNICAL FIELD

This invention relates to a device useful for pitching baseballs and other spherical objects at selected motion characteristics for purposes of either recreation or as a training aid for persons regularly engaged in ball sports, such as baseball. It relates more particularly to a pitching device which is wholly automated, and which can be automatically and readily collapsed into a form which lends itself well to storage and transportation. A device according to the invention may be used by batters, to increase their performance at hitting pitched balls, and may also be used by catchers and fielders, to increase their performance in catching balls travelling at varying rates of speed.

BACKGROUND

It has been an ongoing goal since the earliest of times when objects were first cast or projected from one desired location to another to continuously improve the characteristics of the motion imparted to such object by a human hand or a contrivance designed for such purposes. Hence, the prior art in the field of casting objects is replete with devices such as bows and arrows, catapults, mortars, firearms, guided missiles, and the like. Generally speaking, incremental increases in the degree of control over the linear, rotational, and vibrational motion of various objects have been made in a fairly continuous fashion.

One particularly interesting field of causing the motion of objects is in the American-born sport of baseball. As is well known to those of ordinary skill in the art, baseball may be a recreational activity in which a human thrower ("pitcher") hurls a baseball (defined by regulations as being of a specific weight, diameter, and construction) towards another person ("batter") who holds a wooden, metal, or plastic stick or "bat" in readiness to strike the hurled ball with an impulsive force back in the direction of the pitcher. A successful contact with the baseball permits the batter to run the bases, as is well-known to nearly all US citizens of ordinary skill in observing sports events.

The number of differences in the physical and mental capabilities and characteristics of various individuals who act as pitchers by virtue of the natural variance inherent in a diverse population as currently exists is indeed large. A natural result of these statistical differences is that occasionally an individual having a particularly beneficial set of characteristics comes to act as a pitcher, and the motion qualities provided the baseball during a pitch by such an individual are especially favorable from the standpoint of making the pitches especially difficult for a typical batter to hit the ball. From the earliest times in the game of baseball, observers have studied the paths of balls thrown by the hand, arm, and body of the pitcher, and the interpretation of such observations are full of controversy. The physics of ball flight in general require that the ball thrown must leave the hand from an initial position with an initial velocity in an initial direction and a given spin rotation about a definable axis, and pass through space being acted upon by the presence of the air through which it travels, and the normal force of gravity. Alteration of one or more of these variables may be made or attempted by the pitcher from pitch to pitch, or, a pitcher may try to maintain the same characteristics for a series of pitches. Typically however, batters are highly desirous of increasing their chances of landing a successful hit against baseballs thrown by pitchers whose thrown balls are known to be difficult to hit.

It has long been an objective to attempt to duplicate subsets of these variables by mechanical means in order to give batting practice without tiring the arms of pitchers and the like. Thus the prior art has seen the development of a wide variety of types of contrivances for simulating the flight of a ball as thrown by the human hand, or projected by some other means, or the flight which results as the result of a collision involving impulsive forces, whether elastic or inelastic, as such collisions and the motion associated therewith are believed to be relatively well understood.

It has also been an objective to provide rapidly moving baseballs along the ground or in the air and combinations thereof, in order to provide a method for fielding practice to infield and outfield players. Thus, the number of uses for devices for pitching baseballs is quite varied, and such devices have been gaining in popularity since the first introduction of a reasonably practical device designed specifically for such purposes.

It is desirable in general for pitching machines to be able to pitch a ball spinning with the spin axis in the plane normal to the direction of travel and to spin about the direction of travel. It is also desirable for pitching machines to be able to make a change between these modes of spin, in addition to being able to place the axis of spin in all the possible orientations with respect to the direction of travel. It is also desirable for the direction of the flight of the ball to be well defined from pitch to pitch, being completely dissociated with any level of expertise of the operator who operates the machine or intrinsically related to the design thereof Further, it is desirable for a pitching machine to be readily adjusted when initially placing the machine into a service position. Further still, it is desirable to be able to predict the flight path of the ball when the pitches are changed, as by changing a single or plurality of variables.

U.S. Pat. No. 4,091,791 teaches a ball throwing machine having a flat, circular resilient disc with an off-center opening formed therein through which a ball to be thrown is forced at a predetermined velocity. By properly positioning the flat circular resilient disc, having the off-center opening formed therein, a thrown ball can be made to spin about any axis perpendicular to the ball trajectory. A tubular barrel is mounted adjacent to the resilient disc so that as a ball is forced from the throwing machine it is forced through the opening in the resilient disc and into and out of the barrel. The barrel, which is positionable, permits the ball ejected from the throwing machine to be accurately aimed in any desired direction. A firing chamber is located adjacent the resilient disc on the side opposite the barrel. Balls to be thrown are fed into the firing chamber by a ball feeder. When a ball to be fired is positioned in the firing chamber, the firing chamber to the rear of the ball is sealed and a compressed air charge of a predetermined pressure is introduced into the rear of the firing chamber rapidly forcing the ball through the opening in the resilient disc and out of the barrel. The pressure built up in the firing chamber before the ball is expelled through the resilient disc and the barrel determines the velocity of the thrown ball. Thus it can be seen that any type of curved ball, at any desired velocity, can be thrown from the disclosed ball throwing machine. An air reservoir chamber axially aligned with the firing chamber and the tubular barrel is disposed behind the firing chamber. A firing valve, having an open position allowing free communication between the air reservoir and the firing chamber and a closed position eliminating any communication therebetween, is disposed between the air reservoir and the firing chamber.

U.S. Pat. No. 4,372,284 discloses a baseball-pitching machine wherein a baseball is delivered into the constricted space between, and thereby gripped frictionally by, to oppositely rotating wheels which throw the ball. A single DC shunt wound motor is used to drive the wheels in cooperation with one variable drive pulley and an assortment of guide pulleys. One wheel is driven at a constant speed by the motor while the speed of the second wheel is adjusted by means of a variable drive pulley. By thus changing the speed of one of the two oppositely rotating wheels, it is possible to impart a variety of spins to the thrown ball and thus simulate curve and slider balls thrown by a professional pitcher. The axis of the variable drive pulley is fixed and the position of the belt within the variable drive pulley is controlled indirectly by means of a belt tensioning pulley operated by a screw.

U.S. Pat. No. 4,442,823 describes a pitching machine and control system which will pitch any baseball pitch desired on command with all parameters of each pitch chosen before the pitch of the ball. The system measures and counteracts the effects of the prevailing weather upon the ball then delivers the ball to the chosen point in the target zone. The parameters of the pitch are: orientation of the seams of the ball with respect to the access of spin, orientation of the access of spin with respect to the direction of travel, location of the release point with respect to the center of the machine (including both height and width), velocity of the ball, magnitude of the spin of the ball, and initial direction of the ball. The target parameters which are also selected before pitch are the target location with respect to the release point of the ball. Internal settings of the machine are adjusted to satisfy the pitch, and target parameters and the prevailing weather. Pitch and target parameters can be stored and played back to control the system.

U.S. Pat. No. 5,464,208 relates to a ball pitching machine having a ball feed means for feeding balls to a feeding point where they will be acted upon by rotating drive wheels, a plurality of at least two drive wheels having planes and axes of rotation, said axes of rotation being perpendicular to said planes, said wheels being disposed about said feeding point so as to simultaneously act on a fed ball imparting to the fed ball spin and a forward velocity and trajectory, outwardly away from the feeding point in a direction initially perpendicular to the axes of rotation and in the plane of the wheels. The rotating means is constructed for rotating each drive wheel independent of other drive wheels at a plurality of pre-selected rotational speeds thereby effecting a type of pitched ball having a predetermined trajectory. A tilting means is provided for altering the trajectory, upwardly or downwardly, in a vertical plane, coplanar with the plane of the drive wheels. A panning means is provided for altering the trajectory of the ball in a plane perpendicular to the plane of the drive wheels. A speed measuring means is provided for determining the speed of the moving ball, and a computer means for inputting at least one set of variables that determine the trajectory based on the speed of the ball and at least one set of variables for effecting the spin applied to the ball by the drive wheel.

U.S. Pat. No. 5,771,621 discloses a portable ball pitching machine for projecting a ball uses a combusting gas to drive a piston which compresses air behind a ball and propels the ball through a barrel. A combustible mixture of air and propane are introduced into a combustion chamber, and a ball is loaded against an air exit of a barrel housing. The gas is ignited in the combustion chamber, and the explosion drives a piston through a compression chamber and generates compressed air. The compressed air is directed through the barrel housing to the air exit and the ball, and the ball is propelled from the barrel. The azimuth and elevation position of the barrel are adjustable. The velocity of a projected ball is adjustable by adjusting a regulator which vents to the atmosphere a portion of the compressed air that would otherwise be directed against the ball.

U.S. Pat. No. 5,832,909 teaches a ball pitching machine which uniquely embodies a single, specially configured ball engaging wheel which is rotatably mounted within a wheel housing that, along with a ball receiving barrel, is easily rotatable through an angle of 270 degrees. With this novel construction, the device can be used to accurately pitch a variety of fast balls, curve balls and sliders. The ball engaging wheel of the pitching head is of a novel vaned construction so that as the wheel is rotated within its housing a negative pressure will be generated within the housing and within the ball receiving barrel which is associated therewith so that the ball will be sucked into the barrel and into positive driving engagement with the periphery of the rotating wheel.

U.S. Pat. No. 5,865,161 shows a ball pitching machine having an integral pitching barrel and motor mount and three spaced drive wheels partially projecting into the barrel to grip and propel a ball placed in one end of the pitching barrel. The barrel has three longitudinally aligned slots or windows in the surface of the barrel to provide clearance for secant portions of each of the three wheels. The planes formed by each drive wheel extend radially from the longitudinal axis of the barrel. Each radial plane is equally spaced from each other at 120 degrees relative to each other. Each domed drive wheel is rotatably mounted on the end of a rotatable drive shaft of an electric motor. The three electric motors are mounted on the integral pitching barrel and mount by C-shaped clamps. The barrel is supported by a wheel mounted frame, a pair of U-shaped brackets secured to the frame in an opposed facing relationship, a front support ring for rotatably securing the ejection end of said ball pitching device, and a rear support ring for rotatably securing the feed end of the ball pitching device. The front support ring and the rear support ring are mounted in a spaced apart relationship between the opposed facing U-shaped brackets to form a generally open rectangular-shaped support member for rotatably mounting and adjusting the vertical angle of the ball pitching machine.

U.S. Pat. No. 5,897,445 discloses a baseball pitching machine that employs a counterrotating wheel type baseball launch subsystem that pitches a series of baseballs, and a computer controlled system for selecting the type and percentage of pitches, pitcher and batter characteristics, strike zone areas and other parameters to provide a meaningful batting training session. The pitching machine includes a ball transport subsystem including a carousel for receiving and transporting baseballs in sequence to a position adjacent the counter rotating wheels. While being transported, each baseball stops at seam orienting stations where seam rotators rotate the baseball to provide a commanded seam orientation for the particular pitch selected. The baseball is oriented by the ball orienter for insertion in the launch subsystem. A computer allows the selection by the operator of a variety of pitches, random or selected order. The computer has memory capability for storing pitches corresponding to any pitcher's typical pitch pattern and the system includes video, audio and data recording to record each batting session. An alignment system is included utilizing a laser light source. A remote control is also provided for the batter or his coach. A manual baseball inserter is disclosed for use with other pitching machines.

From a glimpse of these and other similar devices in the prior art, it can be seen that no prior art machine provides all of the following desirable features in a single device: a) having axes of rotation about the point at which the ball exits the device when delivering a pitch; b) capability to pitch any curve with varying spin; c) capability to simulate right-hand, left-hand, sidearm, overhead, or underarm delivery; d) capability to vary the altitude angle of the trajectory of the ball for simulating batted balls to infield or outfield practice, as well as pitched balls to the batter; and capability to vary the azimuth angle to compensate for the spin and curve; e) capability to be compacted for storage; capable of being readily maneuvered; f) capability to cast a ball to simulate any type of flight of a ball, including but not being limited to thrown balls, batted balls and struck tennis balls; g) a means for conveying visual information before a pitch and for conveying pitch statistics to the batter after a pitch has been delivered; h) capability of consistent pitch timing without the use of complex mechanisms; and i) capable of being controlled by conventional controller hardware and software, in which pitch characteristics may be stored, and from where a single pitch, a series of pitches, or a combination thereof may provided.

It is an object of this invention to provide a device having the foregoing capabilities and qualities, and to be able to change any one or more of the variables between each and every pitch rapidly in a very short interval of time; to predict and control the flight of the ball and its point of impact at a target any practical distance away; and effect a vertical or horizontal traverse of the ball at any height above or below the height of the machine, the flights not being limited to curves in a vertical or horizontal plane.

It is a further object of the invention to provide all of the aforesaid features and to simulate to a batter, catcher, fielder, or other person or player by modeling the complete character of the ball in flight as if it were pitched by the human hand, so as to provide an opportunity to bat, catch, observe, train, or exercise in the absence of a person designated to pitch such balls, and to provide a feedback of the information about the pitch to those interested. These and other objects of this invention will become apparent from the following description of the invention.

SUMMARY OF THE INVENTION

The present invention is a device useful for pitching spherical projectiles including baseballs and the like. A device made in accordance with the invention includes a frame portion that is substantially horizontal in construction, and which also comprises a beam portion extending upwardly from the frame portion. This vertical beam portion has a lowermost portion and an uppermost portion. The lowermost portion is attached to the frame portion using conventional means. A pitching head support beam having an upper portion and a lower portion is pivotally attached to the uppermost portion of the vertical beam. To the pitching head support beam is connected a pitching head assembly, and it is from the pitching head assembly that balls are emitted during use of a device according to the invention. The pitching head assembly includes a ball ejection hole, and a plurality of velocitizing means disposed in close proximity to the ball ejection hole, wherein it is the velocitizing means which impart kinetic energy to the ball sufficient for its flight. The invention also includes a magazine means for storing balls for delivery to the ejection hole and a conduit means through which the balls pass from the magazine to the delivery hole. There is also at least one motive means for effecting rotational motion to said velocitizing means.

In a preferred form of the invention, the pitching head support beam has an electric actuator attached to its lower portion, wherein the electric actuator is also in rigid connection with the frame portion. By such an arrangement, the pitching head support beam may, through energization of the actuator, be caused to change from being in a substantially horizontal disposition to a substantially vertical orientation. Such feature is especially valuable for reducing the overall size of a device according to the invention as a whole, for purposes of transportation and storage.

Further, the pitching head assembly comprises a flat plate as a central element of construction, and this flat plate includes a delivery hole through which a ball to be pitched from the device ultimately exits the device. It will be appreciated from the description which follows that this flat plate may be caused to take on various orientations in space. In a preferred form of the invention, delivery of the balls from the magazine is effected for the most part using the force of gravity.

Since all of the various functions and movements of a device according to this invention are in both degree and magnitude controlled by electrical energy pulses, regardless of the duration or frequency of such pulses, all functions, including those which control the flight characteristics of a ball pitched from a device according to the invention, may be readily controlled using computer hardware and software that are commercially readily available. Thus, a device according to the present invention may be programmed to emit pitched balls having any set of pre-selected characteristics as determined as desirable by the user.

DETAILED DESCRIPTION

Figure 1:
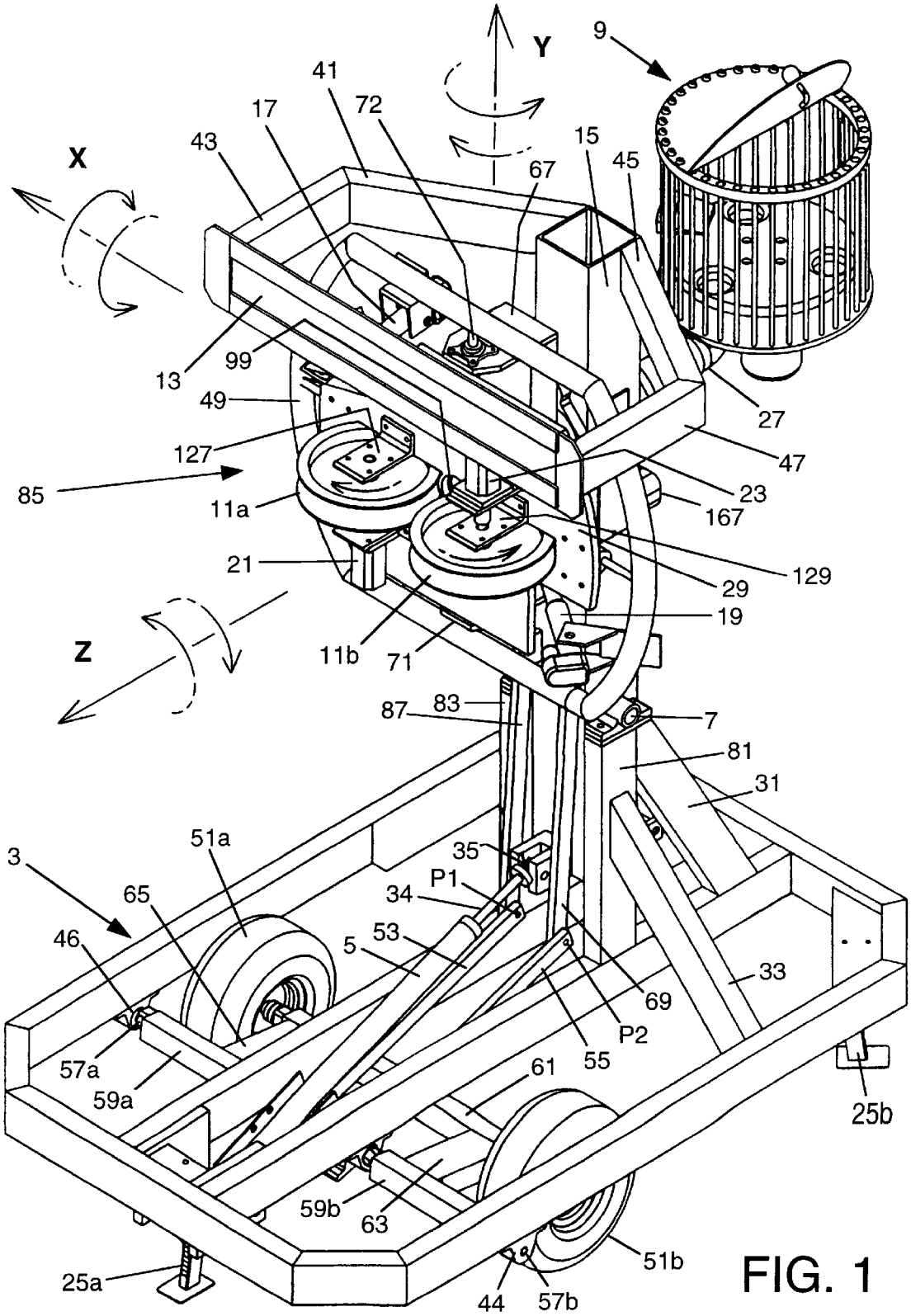
FIG. 1 is a perspective view of a device according to the invention, in its ready-to-use position.

Referring to the drawings, and initially to FIG. 1 there is shown a pitching machine according to the invention. The frame portion 3 is central to the device as a whole, as it is upon or to the frame portion that the essential cooperative components of the invention are all housed or connected. Preferably, the frame portion is substantially rectangular in shape as viewed from above, and is constructed of beam stock which may be solid or hollow, but is preferably hollow to minimize the overall weight of the device. The frame portion includes struts or braces within the internal area defined by its outer perimeter.

In a preferred form of the invention, the frame portion is substantially planar as viewed from its side, and is wheeled, that is, it incorporates a plurality of wheels, and in one form of the invention comprises a pair of wheels 51*a* and 51*b*, which are connected to one another with a common axle means (not shown). According to one preferred form of the invention, the axle about which the wheels rotate is housed within an axle housing 61, which is connected by means of braces 63 and 65 to pivotal rods 59*a* and 59*b*, respectively, to confer upon the wheels the ability to be swung down or up with respect to pivot points 57*a* and 57*b* automatically upon collapsing or raising the pitching head, as is shown in side perspective in FIG. 3 by the arrow denoted "S". Thus the wheels automatically retract when the pitching head support beam 15 is in its vertical raised position and are automatically lowered when the pitching head support beam is lowered to the "stored" position. The pivot points preferably include a bearing means 44 and 46 mounted to the underside of the frame through which pivotal rods 59*a* and 59*b* are mounted. In a preferred form of the invention, the frame portion also includes retractable leg means 25*a* and 25*b*, with a third 25*c* (not shown) located in the opposite corner of the frame position as 25*b*, but on the opposite side of a line of symmetry that bisects the frame parallel to its longest length dimension and passes through the location of 25*a*. The purpose of these leg means is to provide rigid legs upon which the device as a whole may be supported when the wheels 51*a* and 51*b* are raised as a result of the pitching head support beam 15 being caused to be in the vertical (or "raised") position.

According to the invention, there is attached to the frame portion a vertical beam means, which in a preferred form of the invention comprises a plurality of vertical beams 81 and 83, which extend upwardly at about a 90 degree angle with respect to the plane of the substantially rectangular frame portion. In such embodiment, it is preferred that each of the vertical beam(s) are supported by braces such as 31 and/or 33, or the like, to confer added strength and stability to the pitching head assembly from which projectiles are ultimately delivered when the device is in its "ready-to-fire" configuration. The vertical beams 81 and 83, which like all other supports of the invention are constructed of either bar stock, beam stock, or a functional equivalent thereof in terms of strength, include a lower portion that is connected to the frame portion, and an uppermost portion to which is affixed a pivot means 7 that serves as the pivot point of the pitching head support beam 15, the function of which is to provide rigid support the pitching head assembly 85 and to serve as a hinge about which the pitching head support beam swings when caused to change from a horizontal to a vertical attitude. Preferably, the pitching head support beam includes a hole disposed through its construction in a direction perpendicular to its length dimension to provide for the passage of a ball feed conduit 27 entirely through it, unobstructed, as more clearly shown in FIG. 3. The pitching head support beam has an upper portion 210 (FIG. 3) to which is attached the pitching head assembly 85, and a lower portion 211 (FIG. 3) that is pivotally attached to the vertical beam means which preferably comprises vertical beams 81 and 83, although the present invention contemplates the use of functionally equivalent vertical beam means, such as a single beam that is cut or machined to provide for the motion of the moveable arm of the actuator 5 and linkages 55, 69, 53, and 87, all of which cooperatively operate to raise and lower the wheels 51*a* and 51*b* upon energization of actuator 5, as such functional equivalents are known in the art or become apparent to one of ordinary skill after reading this specification and the appended claims.

Figure 2:
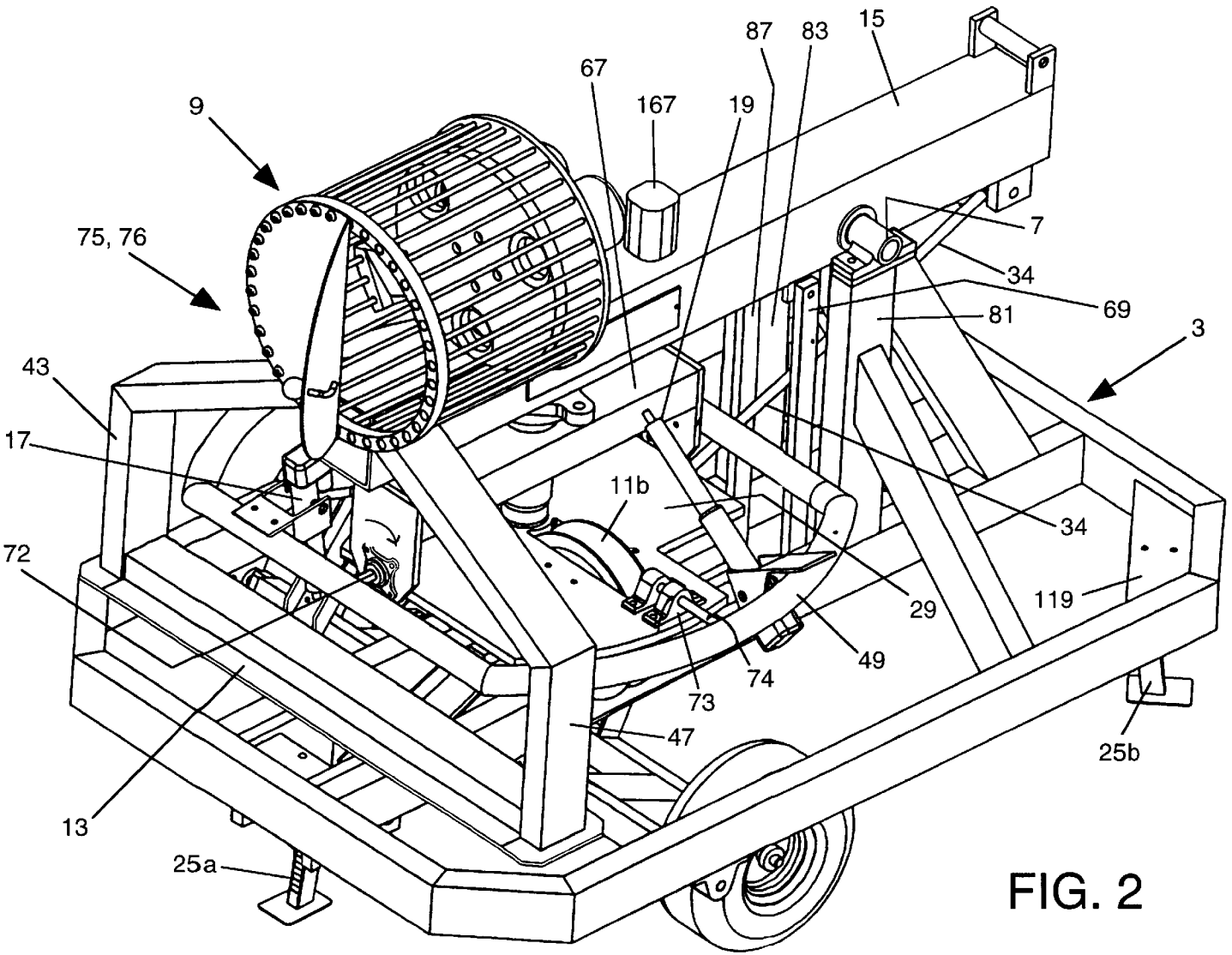
FIG. 2 is a perspective view of a device according to the invention, in its compacted position, ready for storage or transportation.
Figure 3:
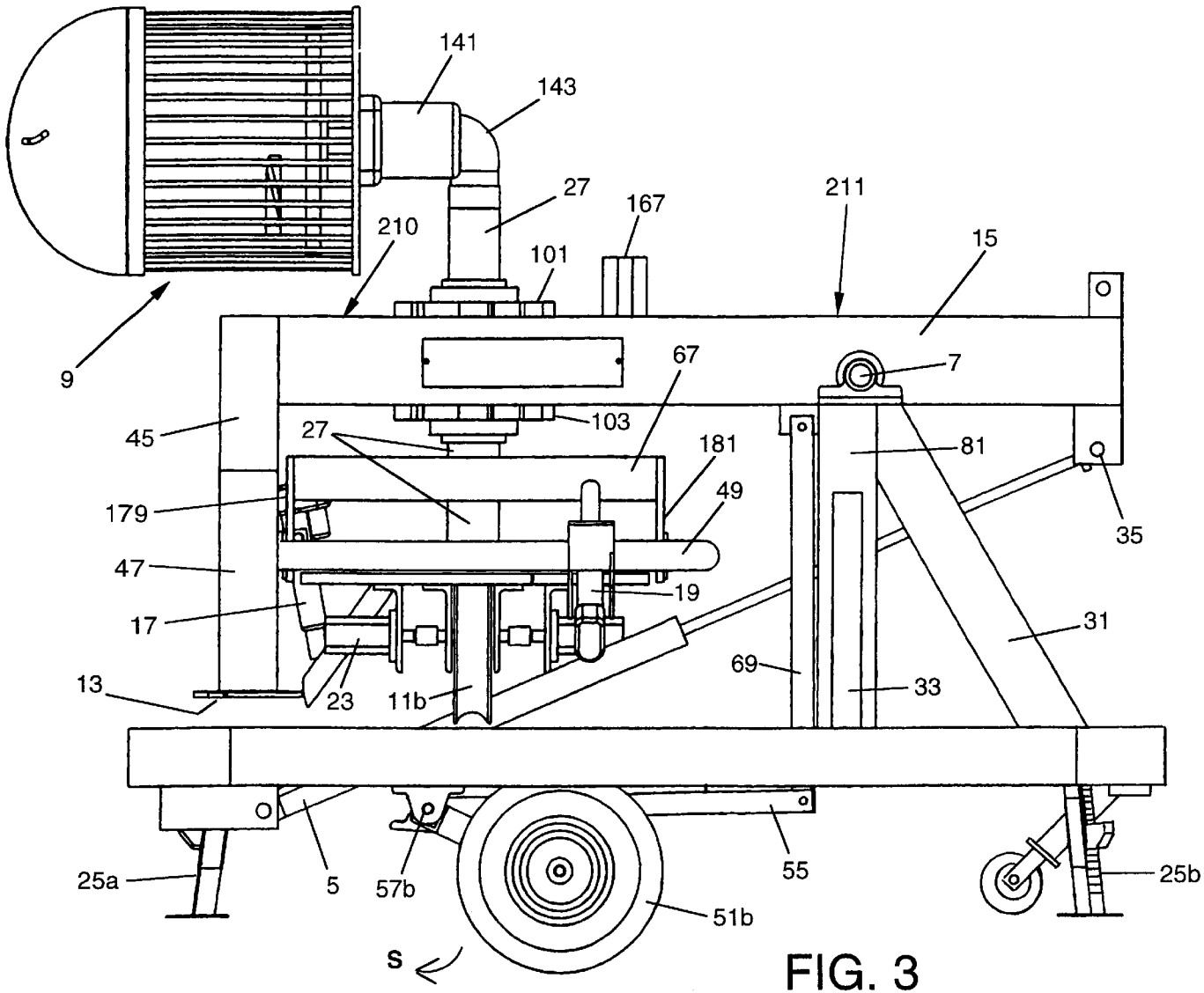
FIG. 3 is a side view of a device according to the invention, in its compacted position, ready for storage or transportation.

Joined to the frame portion at one end is an electromechanical actuator 5 which is preferably of the electric type, such as that sold by Duff Norton of Charlotte, N.C. under model number SK-6415-200. However, other actuators which are functionally equivalent to this are also anticipated as being useful for the invention. The one end of the actuator that is not connected to the frame portion is connected to the pitching head support beam 15 in sufficient position using a pivotal connective means 35 (such as a pin and yoke, or a bearing means) such that when the moveable arm of actuator 5 is set into motion, the pitching head support beam is caused to undergo an orientation change from either horizontal to vertical, or vice versa, depending on the starting configuration. Such a change in orientation is beneficial from the standpoint of rendering the device as a whole into a more compact form for transportation and storage purposes, and as mentioned causes an attendant raising or lowering of the wheels 51*a* and 51*b*. Associated with the actuator 5 are linkages 55, 69, 53, and 87, which are used to raise and lower the wheels 51*a* and 51*b* and which in one form of the invention are bar stock of sufficient length which are pivotally attached to one another at the points P1 and P2, the other ends of which stabilizer linkages are attached to the frame portion and the pitching head support beam as also shown in FIG. 2 and FIG. 3.

The device as a whole appears as in FIG. 1 when balls are being pitched, i.e., the pitching head assembly 85 is in the orientation shown in FIG. 1 when in its ready-to-fire position. The pitching head assembly comprises a head assembly plate 29 as a central element of its construction to which various other essential elements are preferably attached in a preferred form of the invention, including the motive means 21 and 23 which drive the left velocitizing means 11*a* and the right velocitizing means 11*b*, respectively.

At the top portion of the pitching bead assembly 85 there is a message marquis, 13, the use of which are well-known in the art, for delivering a visual message to a batter. The marquis is held in position by means of support braces 41, 43, 45, and 47, which are preferably connectively attached to one another in the configuration depicted in FIG. 1. Preferably, these support braces are rectangular tubular stock, and any connective means such as welds, rivets, machine screws, nuts and bolts, etc., including all known means for connecting braces to frames or metal plates are useful for purposes of the invention, which known means for connecting are also useful for connecting other various elements of the invention to one another. A set of electric actuators 17 and 19 are also functional elements of the pitching head assembly, and are useful for causing a change in orientation of the substantially planar head assembly plate with respect to the device as a whole. These actuators are preferably of the electric type, such as those sold by Thompson Saginaw of Saginaw, Mich. as model number 7822920. However, other actuators which are functionally equivalent to these are also anticipated as being useful in similar regard.

Also shown in FIG. 1 is the location of the ball magazine 9, which is used to store baseballs or other projectiles that are to be pitched by the device. The ball magazine and its relation to the pitching head assembly are more thoroughly described in other figures. The invention comprises a ball delivery hole 99 through which a ball exits a device according to the invention immediately prior to its being imparted with the necessary energy for its flight.

FIG. 2 shows a device according to the invention in its compacted position. A device according to the invention may be caused to exist in its compacted position by virtue of the arm 34 of the actuator 5 being extended upon its energization, owing to the pitching head support beam 15 being pivotally mounted at 7 using, for example without limitation, a pipe or pin that extends through the pitching head support beam which rests in or on a bearing means, although other functionally equivalent means for providing a pivotal attachment known in the art are also anticipated as useful herefor, including hinges and the like.

The same elements of FIG. 1 are shown in this FIG. 2, including the stabilizer legs 25*a*, 25*b*, and 25*c* (not shown). These stabilizer legs comprise a pad portion, and a shaft portion which includes a serrated surface that functions cooperatively with a detente mechanism, as is known in the art, to rigidly maintain the pad portion in contact with the surface upon which the device as a whole rests at any desired force within the limits of the motion of the shaft. Such stabilizer legs are well known for this use, and are preferably those available from Northern Tool of Burnsville, Minn. under model number 12756-F722, although other functionally equivalent stabilizer legs are useful herein. Generally, when the device is caused to assume the configuration of FIG. 2, the stabilizer legs are at some point manually caused to be completely retracted in order that the device may be wheeled about to a selected destination, and, upon arrival, the stabilizer legs may be again lowered to preclude the device from being moved further. Preferably, the stabilizer legs are mounted to plates which plates, such as 119, are affixed to the frame in such fashion to serve a dual function also as strengthening supports for the frame itself.

In FIG. 2 is shown portions of the rear of the pitching head assembly, including the connective bearing 73 that is attached to the head assembly plate, about which the head assembly plate may be rotationally tilted by virtue of the pivot axle 74 being rigidly attached to the head assembly bar 49. The head assembly bar portion 49 in one preferable form of the invention, comprises two parallel linear portions each having a first and a second end portion, which linear portions are joined to one another at their end portions by means of two curved portions which for convenience shall be referred to as the left curved portion and right curved portion, and as later shown in FIG. 10B as LP and RP, respectively. There is another pivot axle 76 (not shown in FIG. 2) attached to the head assembly bar at a location opposite the pitching head support beam from pivot axle 74, which pivot axle 76 cooperates with a connective bearing 75 (not shown) that is attached to the head assembly plate analogously to the way the connective bearing 73 and pivotal axle 74 cooperate. Thus, the head assembly plate 29 is to some measure rotatable about the axis "x" shown in FIG. 1 with respect to the head assembly bar 49, and the pitching head support beam 15, i.e., the axes of the pivotal axles 74 and 76 are parallel with the axis "x".

The head assembly bar portion 49 is disposed coextensively about the head assembly plate 29 and its various appendages and wares. At the top portion of the head assembly bar 49 there is a connective bearing 72 which, together with its counterpart connective bearing 71, the locations of which are shown in FIG. 1, (and also depicted in FIGS. 11A and 11C as being connected to the head assembly support beam 67 as later described), permits movement of the entire pitching head assembly (including the head assembly plate 29 and the head assembly bar 49) with respect to the head assembly support beam 67 about the axis "y" of FIG. 1. Thus, rotation of the head assembly plate 29 about the "x" axis may occur simultaneous to or independent of rotation of the entire pitching head assembly about the "y" axis.

In a preferred form of the invention, the head assembly support beam 67 is of the shape of a rectangular solid, having a first end portion and a second end portion, and includes at least one hole completely through it in a direction perpendicular to its length dimension so as to allow for the ball feed conduit to pass completely through it, unobstructed as shown in the various figures. The bearing means 71 and 72 are preferably of the SCJ ¾ 4-bolt flange and VAK 5/8 pillow block type, such as those manufactured by FAFNIR Bearings of Torrington, Ky. These bearing means are preferably affixed to the pitching head assembly support beam 67 near or at its end portions, by means of connective bearing support arms 179 and 181 which may merely be plates of steel, aluminum or other rigid and functionally equivalent material connectively disposed at the first end portion and the second end portion of the head assembly support beam. Such described capability of rotational motion of the pitching head assembly about the y-axis is facilitated by actuation of the actuators 17 and/or 19 either alone or in cooperation with one another to provide a desired attitude. The actuators 17 and 19 are each affixed at one of their ends to the head assembly bar 49, and preferably in the positions shown. The end of 17 that is not affixed to the head assembly bar 49 is rigidly attached to the head assembly plate 29, while the end of 19 that is not affixed to the head assembly bar 49 is rigidly attached to the head assembly support beam 67, as is more clearly shown in FIG. 11C. Thus, energization of actuator 17 causes rotation of the head assembly plate 29 about the "x" axis, while energization of actuator 19 causes rotation of the head assembly bar (including the head assembly plate) about the "y" axis. Such adjustment of the orientation of the head assembly plate and its face provides flexible control over flight characteristics selected for a pitched ball, especially when combined with the opportunities afforded by adjustment of the rotational speeds of the velocitizing means 11*a* and 11*b*.

The head assembly support beam 67 is preferably welded to the ball conduit tube 27 which passes through and supports the head assembly support beam 67, which itself is rotably connected to the pitching head support beam 15 by means of ball conduit tube 27, as shown in FIG. 3, which figure shows the various elements of FIG. 1 and FIG. 2 from the side perspective. The ball conduit tube 27 is a strong tubular element having an interior hollow through which baseballs may pass, that is connected to the ball magazine 9 by means of an elbow connection 143. The ball conduit tube 27 is attached to the pitching head support beam 15 by means of bearings 101 and 103. The flange bearings 101 and 103 are rigidly affixed to pitching head support beam 15, preferably by means of nuts and bolts. In a preferred form of the invention, the ball feed conduit 27 exists in segments, and the flanges 101 and 103 are of the type that permits rotation of the ball feed conduit to thus permit rotation of the pitching head assembly 85 about the "z" axis in FIG. 1 without an attendant rotation of the ball magazine 9 from its preferred orientation as is shown in FIG. 1.

Figure 4A:
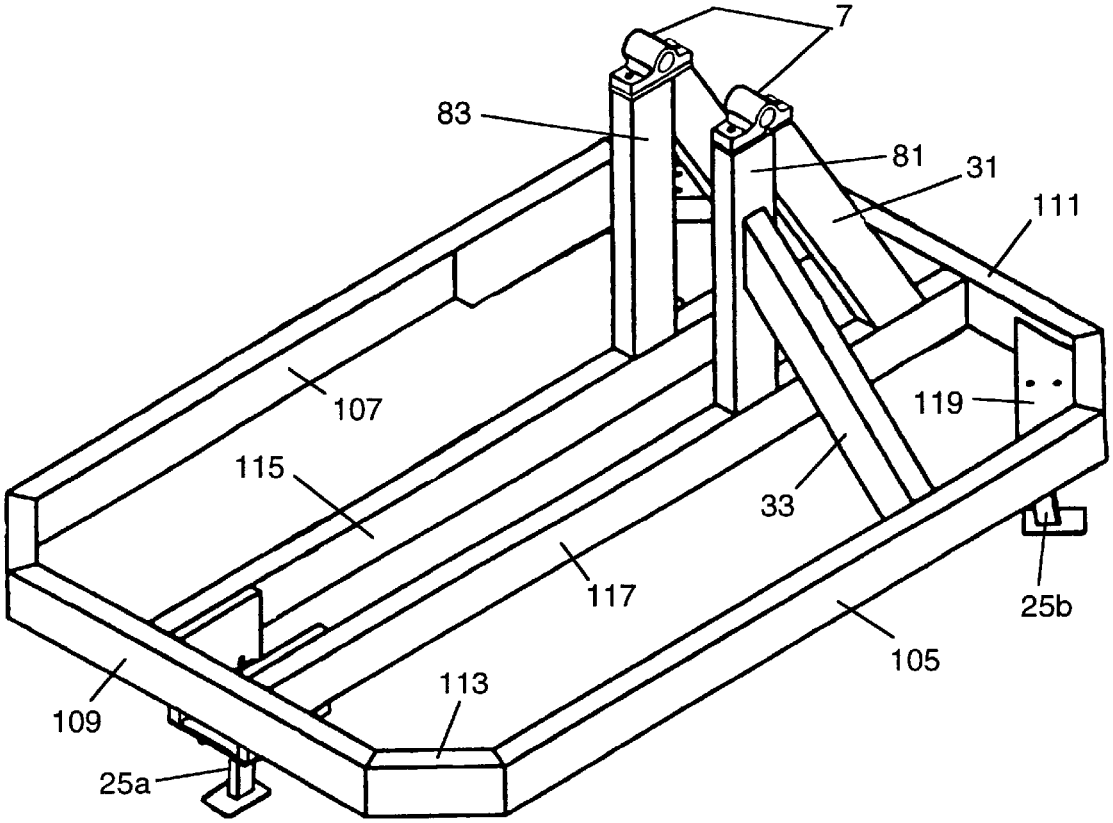
FIG. 4A is a perspective view of a frame portion according to one form of the invention.
Figure 4B:
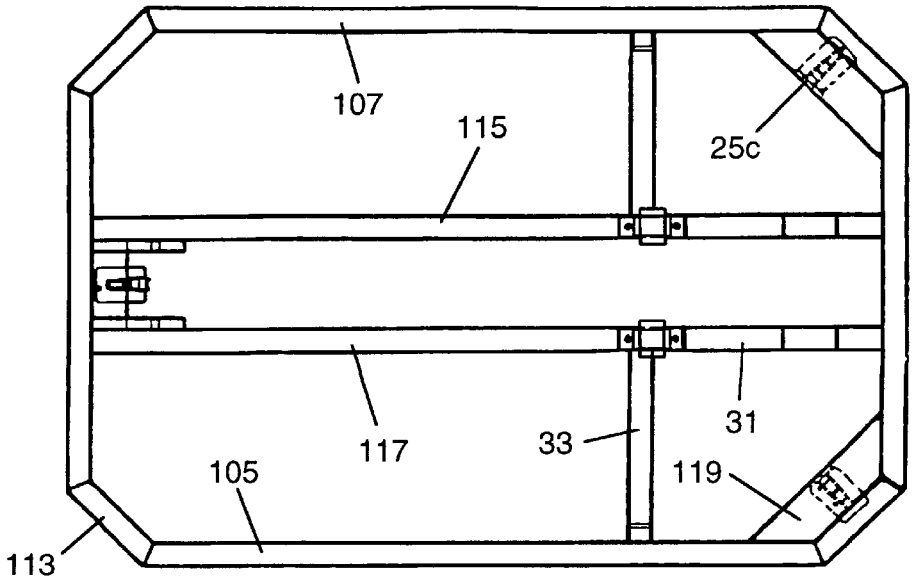
FIG. 4B is an overhead view of a frame portion according to one form of the invention.
Figure 4C:
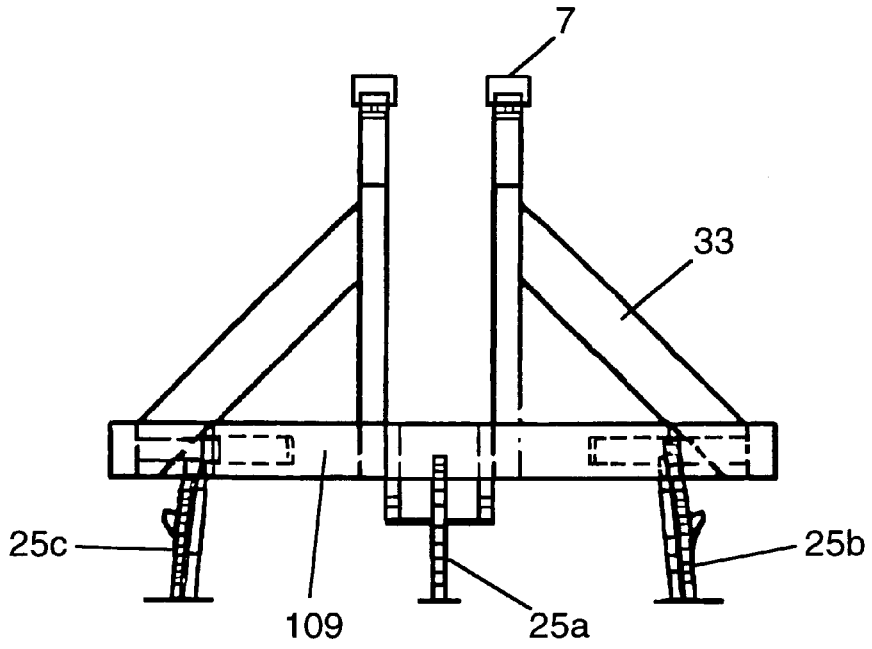
FIG. 4C is an end perspective view of a frame portion according to one form of the invention.
Figure 4D:
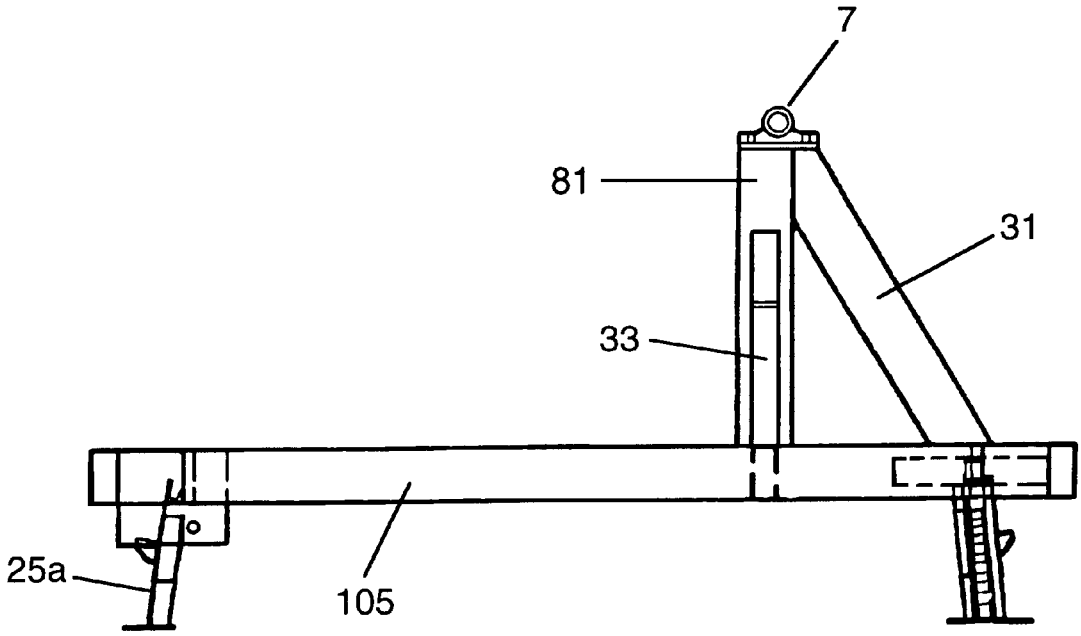
FIG. 4D is a side perspective view of a frame portion according to one form of the invention.

In FIG. 4A, a perspective view of the frame portion according to a preferred form of the invention is depicted, showing the substantially rectangular shape of such frame, including long beams 105 and 107, short beams 109 and 111, corner beam 113, braces 115 and 117, and corner brace 119. Right vertical beam 81 having a component of a hinge means 7 is shown, with its supporting braces 31 and 33. The remaining figures, FIG. 4B, FIG. 4C, FIG. 4D are top, end, and side perspective views of said frame portion, respectively, which show the locations of the various components of the frame portion as seen from these different points of view. The various elements of the frame portion may be constructed of metallic beams such as aluminum, stainless steel, iron, wood beams, reinforced polymeric beams such as fiberglass, graphite reinforced materials, etc., with any material generally known by artisans of ordinary skill in frame construction anticipated as being useful in a functionally equivalent regard. Most preferably, however, the components of the frame portion are made of extruded aluminum or an aluminum alloy, because of their relatively low cost, light weight, and sufficient strength.

Figure 5A:
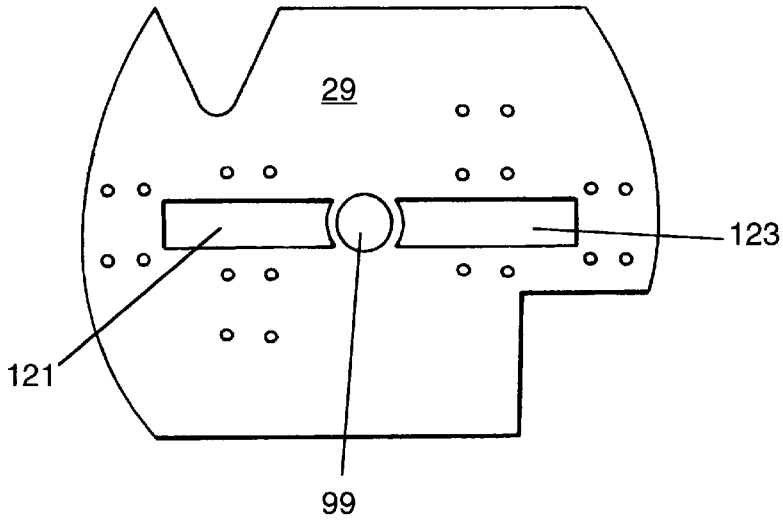
FIG. 5A is a front view of the flat plate which is a central element of a pitching head in accordance with the invention.
Figure 5B:
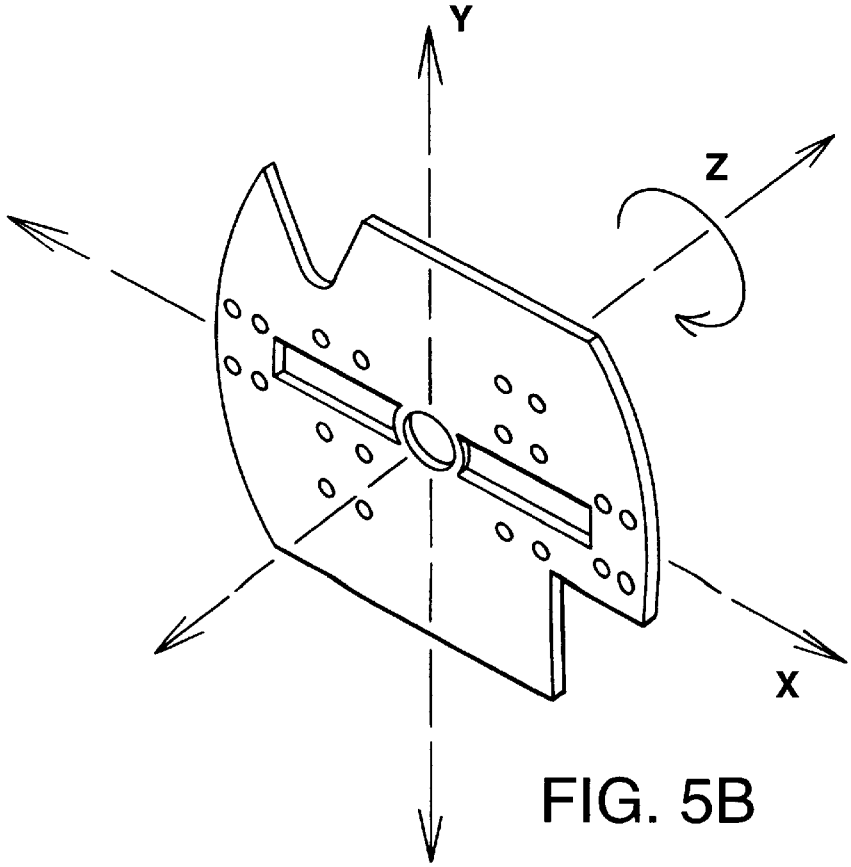
FIG. 5B is a perspective view of the flat plate which is a central element of a pitching head in accordance with the invention.

In FIG. 5A is shown a frontal view of the head assembly plate 29, which is preferably a plate of metallic construction having a thickness of about ½ inch. Preferably, the plate comprises aluminum or one of its alloys; however, any of the materials of construction mentioned as being useful for construction of the frame portion are suitable for constructing the head assembly plate. The head assembly plate includes two rectangularly shaped holes 121 and 123 disposed through its surface, and it is within the confines of these holes that portions of the velocitizing means 11*a* and 11*b* normally reside by virtue of their being held in place by bearing means 127 and 129 shown in FIG. 1 which bearing means are mounted to the head assembly plate 29 with the aid of various threaded holes shown in FIG. 5A but not labeled. The ball delivery hole 99 is also shown, which is a hole disposed through the head assembly plate. FIG. 5B shows a perspective view of the head assembly plate 29 and the various axes discussed in relation to the movement of the head assembly plate with respect to the device as a whole.

Figure 6A:
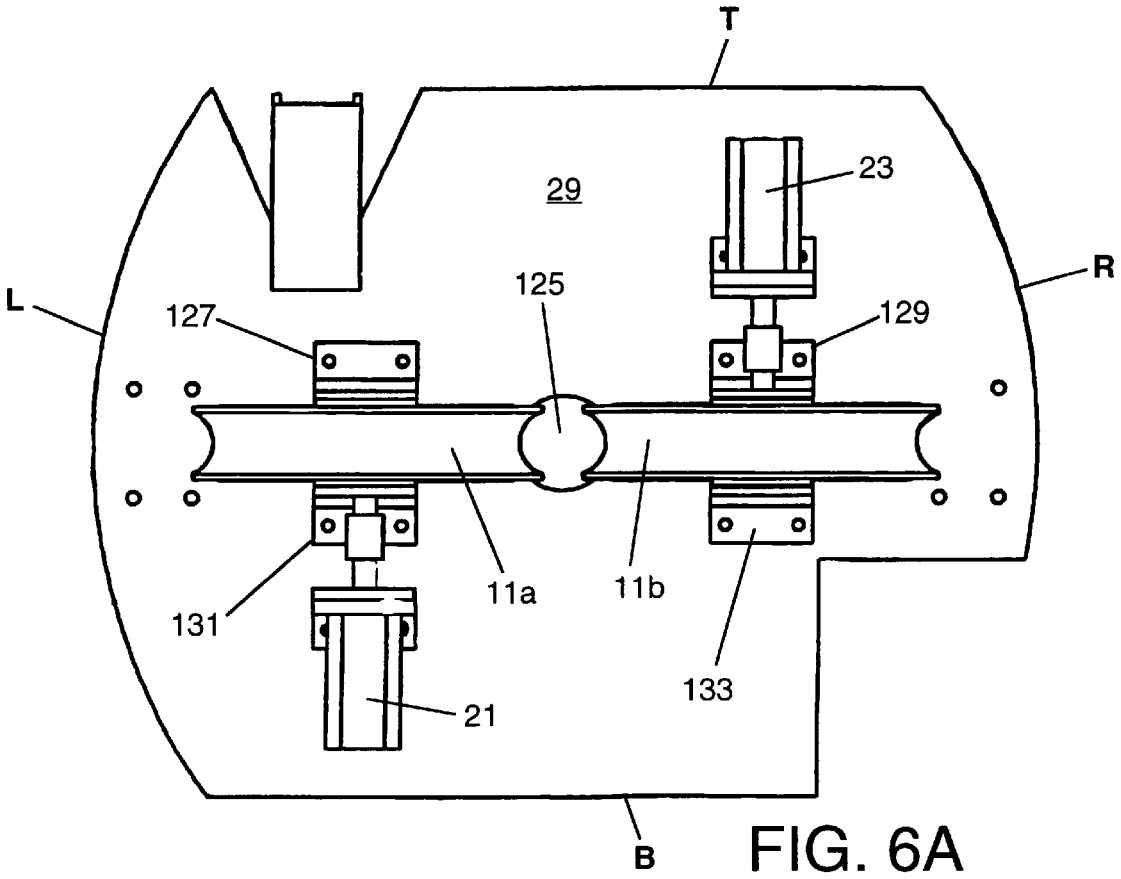
FIG. 6A is a front view of the flat plate which is a central element of a pitching head in accordance with the invention, showing the velocitizing means and motive elements in their preferred locations.

FIG. 6A shows the head assembly plate 29, which preferably comprises a top portion, bottom portion, left side portion and right side portion labeled T, B, L, and R respectively in this figure. In this figure, the head assembly plate has the velocitizing means 11*a* and 11*b* installed, including the various wares associated therewith. Such wares include the bearing means 127, 129, 131, and 133, which are flange mounted bearings such as those manufactured by FAFNIR Bearings of Torrington, Ky. under model number VAK 5/8. Generally speaking, the velocitizing means are round and thus wheel-like in appearance, having a contour such as that shown in FIG. 6A, which contour includes a concave edge portion when viewed from the side, which contour is especially preferable for the utility of this invention as may be understood from consideration of the ball delivery hole 99 in view of the proximity of the concave edges of both velocitizing means 11*a* and 11*b*, for when the velocitizing means are caused to rotate at a pre-selected speed in opposite directions with respect to one another as viewed from the top of the device as a whole, and a ball appears at the velocitizing means side of the head assembly plate, the ball is immediately grasped by both velocitizing means and propelled forward.

The ultimate location of the outer circumference of velocitizing means with respect to the ball delivery hole 99 is determined by the diameter of the balls to be pitched from the device and the cross-sectional shape of the velocitizing means, which dimension may be readily determined by one of ordinary skill in the mechanical arts. Preferably, in the case of baseballs, the velocitizing means are 12 inches in diameter and are located so that their centers of rotation are about 6¾ inches from the center of the ball delivery hole 99, whose diameter is just slightly larger than the diameter of a regulation baseball when the shape of the velocitizing means is concave as shown in the figures.

Preferably, the motive means are DC motors, such as those manufactured by Minarik of Reno, Nev. under model number Boss DB-115, and the shafts of the motors are in direct mechanical linkage with the shafts upon which the velocitizing means 11*a* and 11*b* are rotably disposed by virtue of bearing means 127, 129, 131, and 133. Although the motive means 21 and 23 have been described as direct current (DC) motors, other types of motors are functionally equivalent for purposes of this invention, including alternating current (AC) fed motors. Velocitizing means 11*a* and 11*b* are of the ATEC type, such as those manufactured by ATEC Corporation, or a functional equivalent thereof. Rotating wheels other than those having a concave edge portion as viewed from the side perspective are suitable for use herein including those with flat, convex, or other contours; however those having edges with a concave contour are especially preferred.

Through such an arrangement of the velocitizing means in the vicinity of the ball delivery hole, and given the way in which the orientation of the head assembly plate may be adjusted by control of the actuators 17 and 19 and motor 167, it is possible to achieve an extremely high degree of control over the speed, direction, and motion characteristics at which the ball is projected from the device. The velocity of a projected ball is readily controlled by controlling the speed of the velocitizing means. Further, the velocitizing means need not be rotating at precisely the same rotational velocity, but may be slightly different as when it is desirable to cause a projected ball to possess a spin as it travels. Since the head assembly is rotatable 360 degrees about the center of the ball delivery tube at 27 of FIG. 3, the spin on a projected ball may be in any direction with respect to a batter, depending upon the orientation of the head assembly and the angular velocities of the velocitizing means with respect to one another. The speed of rotation of the velocitizing means is controlled by the motive means 21 and 23, which are preferably electric motors whose speed is readily controllable.

Figure 6B:
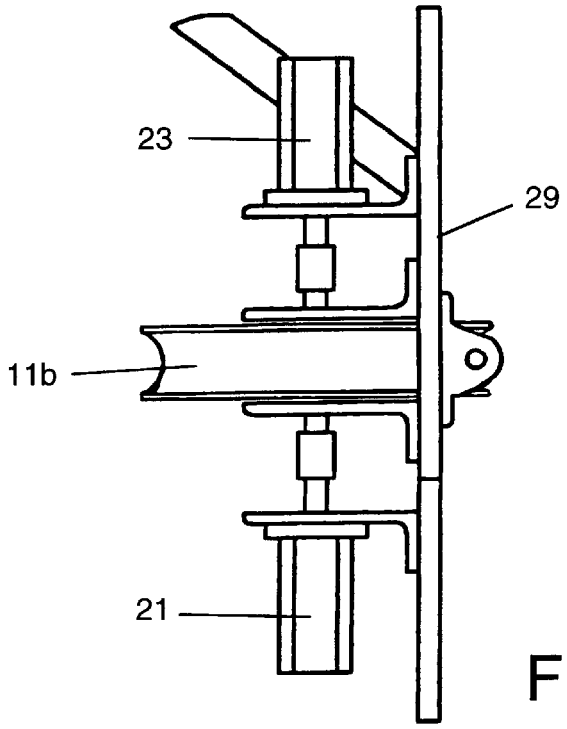
FIG. 6B is an end view of the flat plate which is a central element of a pitching head in accordance with the invention, showing the velocitizing means and motive elements in their preferred locations.

FIG. 6B is a side view of the head assembly plate of FIG. 6A, showing the depth to which the velocitizing means are preferably disposed within the hole portions 121 and 123 of FIG. 5A, which is between about 1/10 and 1/4 of the diameter of the velocitizing means, with about 1/5 of the diameter of the velocitizing means being the preferred amount, when the diameter of the velocitizing means is 12 inches.

Figure 7A:
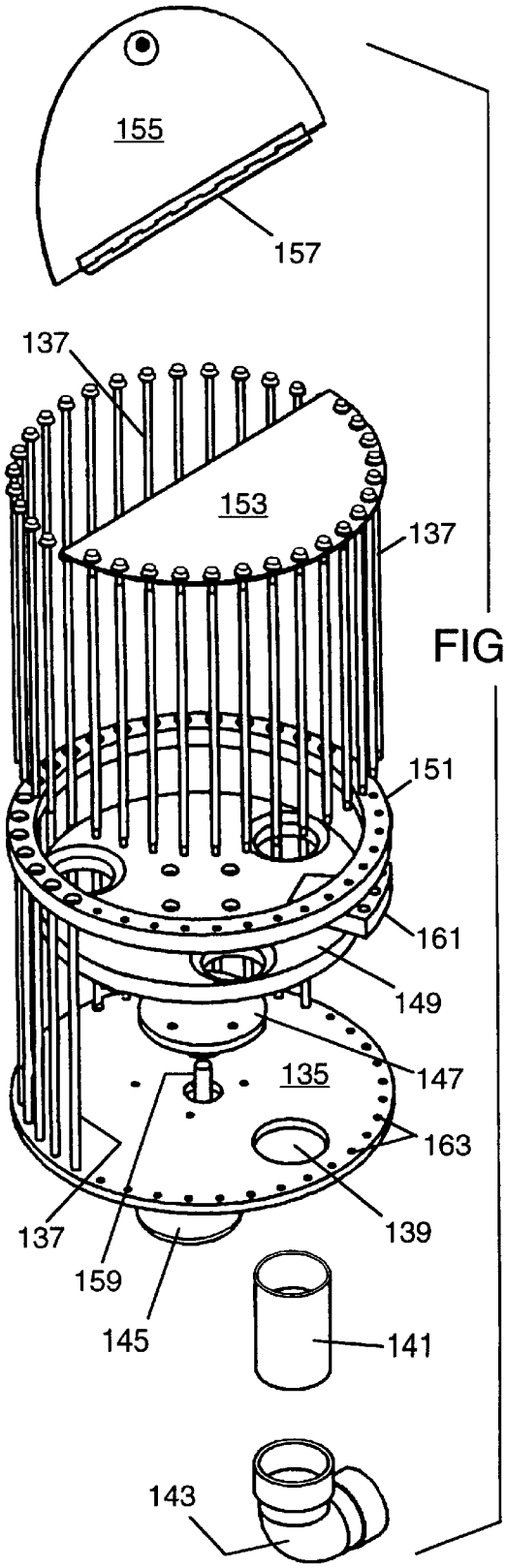
FIG. 7A is an exploded perspective view of a ball magazine according to a preferred form of the invention.

A ball magazine 9 according to a preferred form of the invention is shown in an exploded perspective view in FIG. 7A, from which it is evident that such ball magazine consists of a base plate portion 135 having a plurality of holes 163 about its circumference delivery hole 139, and a hole in its center. There are a plurality of support rods 137 each having a first end portion and a second end portion, wherein said first end portion of each of the support rods is affixed to the base plate portion at the location of the holes 163, which holes are for convenience in attaching the support rods to the base plate, as other connective means such as those already mentioned are functionally equivalent. The rods are disposed about the entire periphery of the base plate portion, so as to form a cage-like structure, the whole of which is provided added strength by means of an upper ring support portion 151 which itself is provided with a plurality of holes about its circumference, the configuration of which is rendered more clear by consideration of FIG. 7C which shows the assembled ball magazine 9. Thus, the second end portions of the support rods are connected to the upper ring support portion.

Disposed within the cage is a rotating plate portion 149 which is a circular plate having a plurality of holes, preferably three, through its surface which are just slightly larger than the diameter of a baseball or other projectile to be pitched. The rotating plate portion is disposed atop of and in mechanical contact with a shaft hub 147, which itself is in mechanical contact with the output shaft 159 of an electrical motor 145, which, when energized to rotate at a pre-selected speed causes rotation of the rotating plate portion at a desired angular velocity. The distance between the base plate portion 135 and the rotatable plate portion 149 in the final ball magazine assembly is equal to about 1/2 to 2/3 of the diameter of a ball to be pitched, such that a number of balls equal to the number of holes in the rotatable plate portion 149 are caused to drop into the holes disposed through the surface of the rotating plate portion to render them to be transported in a circular motion until one of the balls becomes located over hole 139 in the base plate portion 135, at which time such ball falls through the hole in the base plate portion and passes through the short conduit segment 141, into the conduit elbow 143, into the substantially linear ball feed conduit 27 (FIG. 3) and is subsequently delivered to the ball delivery hole 99 to be given motive energy by the velocitizing means.

The distance between the base plate portion and the rotating plate portion is preferably equal to between about 30% and 90% of the diameter of a ball to be pitched, with about 65% being most preferable. Thus balls located within the cage structure are caused to periodically fall into the short conduit segment at a rate that is readily adjustable by altering the speed of rotation of the rotating plate 149 by the motor 145. To prevent jamming of the balls, a baffle 161 is provided which is merely an interference within the cage portion against which balls within the cage rub strike and are deflected which effectively assures consistent feeding of the balls.

Figure 7B:
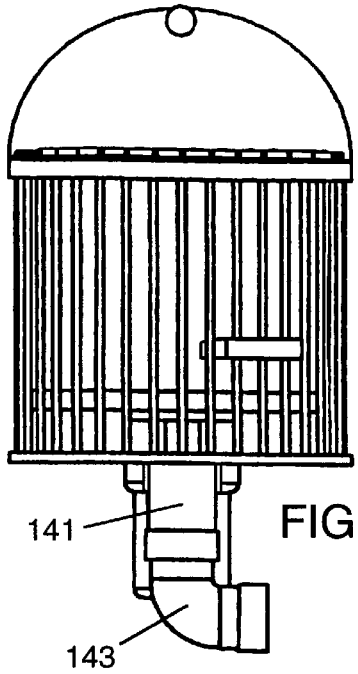
FIG. 7B is a side view of a ball magazine according to a preferred form of the invention.
Figure 7C:
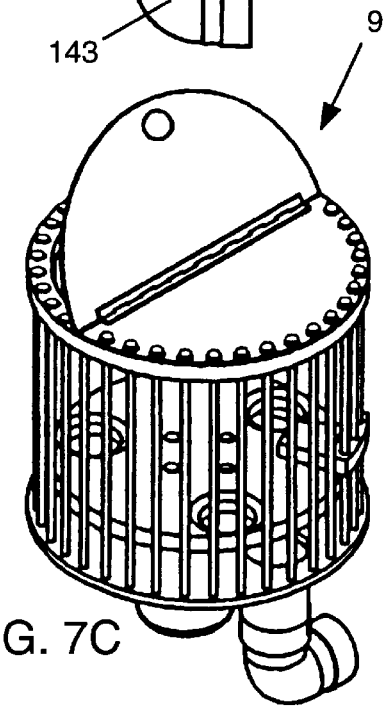
FIG. 7C is a perspective view of a ball magazine according to a preferred form of the invention.
Figure 7D:
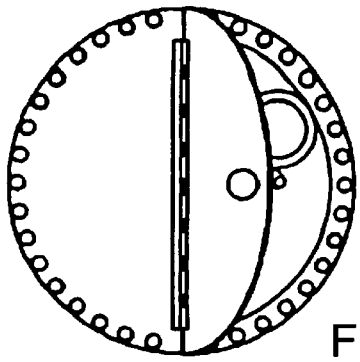
FIG. 7D is an overhead view of a ball magazine according to a preferred form of the invention.
Figure 8A:
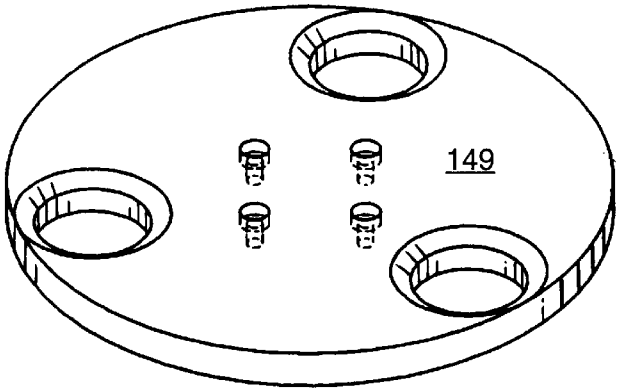
FIG. 8A is a perspective view of the rotating plate portion of a ball magazine according to a preferred form of the invention.
Figure 8B:
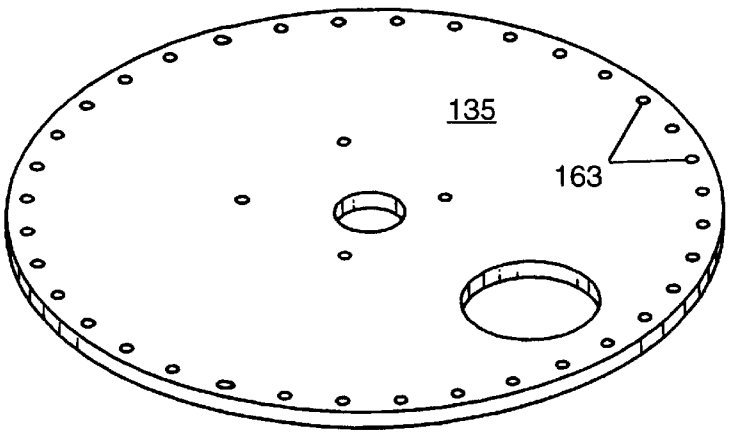
FIG. 8B is a perspective view of the base plate portion of a ball magazine according to a preferred form of the invention.
Figure 8C:
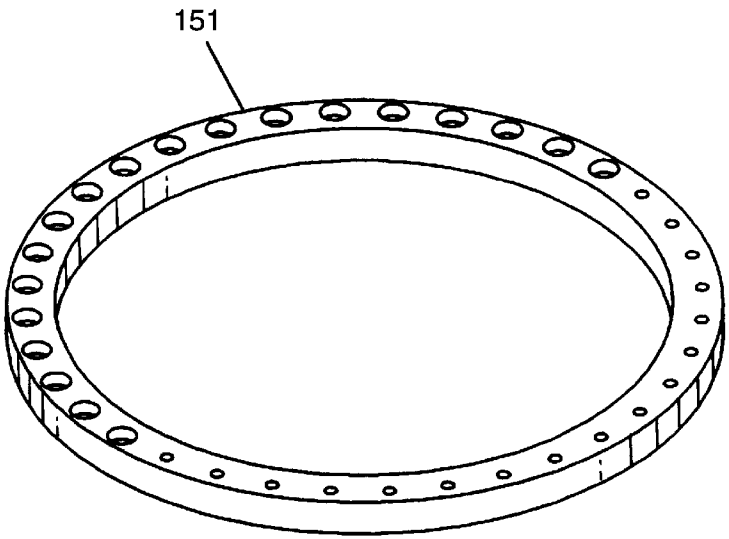
FIG. 8C is a perspective view of upper ring support portion of a ball magazine according to a preferred form of the invention.

There is preferably a top portion 153 disposed about the upper portion of the ball magazine, to which is attached a hinged lid portion 155 by means of hinge 157 which secure the balls in place during storage. FIG. 7B shows the relationship of the aforementioned elements from the side perspective and FIG. 7D is a top view of the ball magazine. The most preferred rotating plate portion 149, base plate portion 135, and upper ring support portion 151 of the ball magazine are shown in perspective view more clearly in FIGS. 8A, 8B, and 8C, respectively.

Figure 9B:
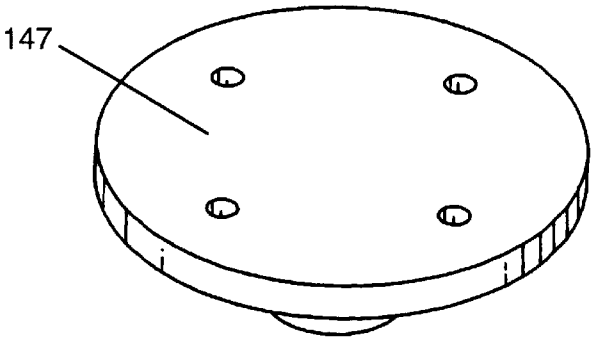
FIG. 9B is a perspective view of the shaft hub of the ball magazine according to a preferred form of the invention.
Figure 9D:
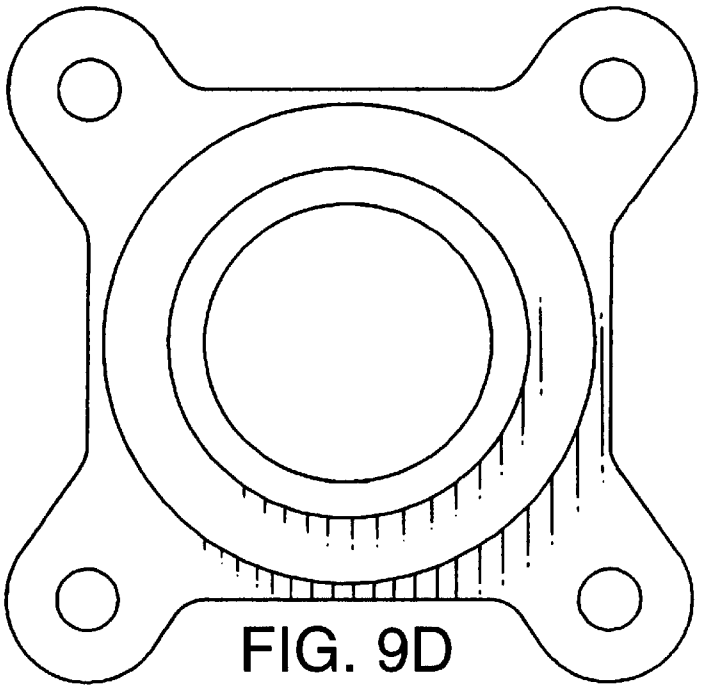
FIG. 9D is a top perspective view of a ball feed tube bearing according to a preferred form of the invention.
Figure 9A:
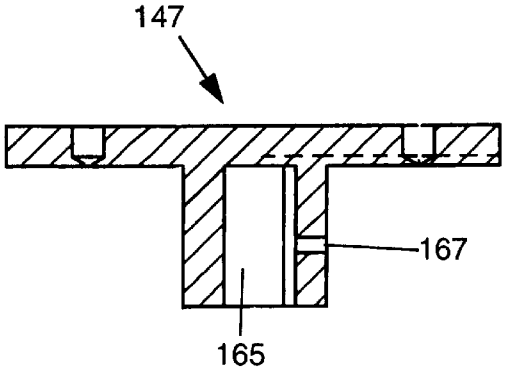
FIG. 9A is a side cutaway perspective view of the shaft hub of the ball magazine according to a preferred form of the invention.
Figure 9C:
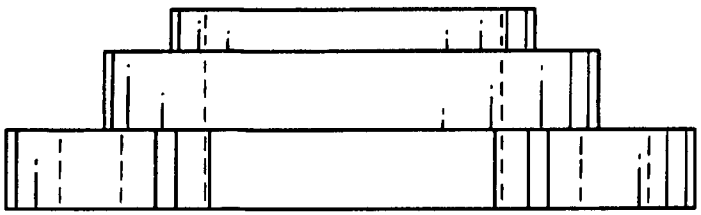
FIG. 9C is a side perspective view of a ball feed tube bearing according to a preferred form of the invention.

In FIGS. 9A and 9B are shown, respectively, a side cutaway perspective view and a perspective view of the shaft hub portion 147 of the ball magazine which includes the hollow portion 165 that rests about the shaft of the motor 145 and which may be affixed thereto by means of a set screw located in the bore 167 which may be a threaded bore. FIGS. 9C and 9D show ball feed tube bearings 101 and 103 in both side view and top views, respectively. Such a bearing means is of the flange type, such as those manufactured by Hub City under model number FB3350H, although tube bearing means which are functionally equivalent in the regard of permitting rotation of the pitching head assembly of the device about the ball delivery conduit are anticipated as being useful in the invention as well.

Figure 10A:
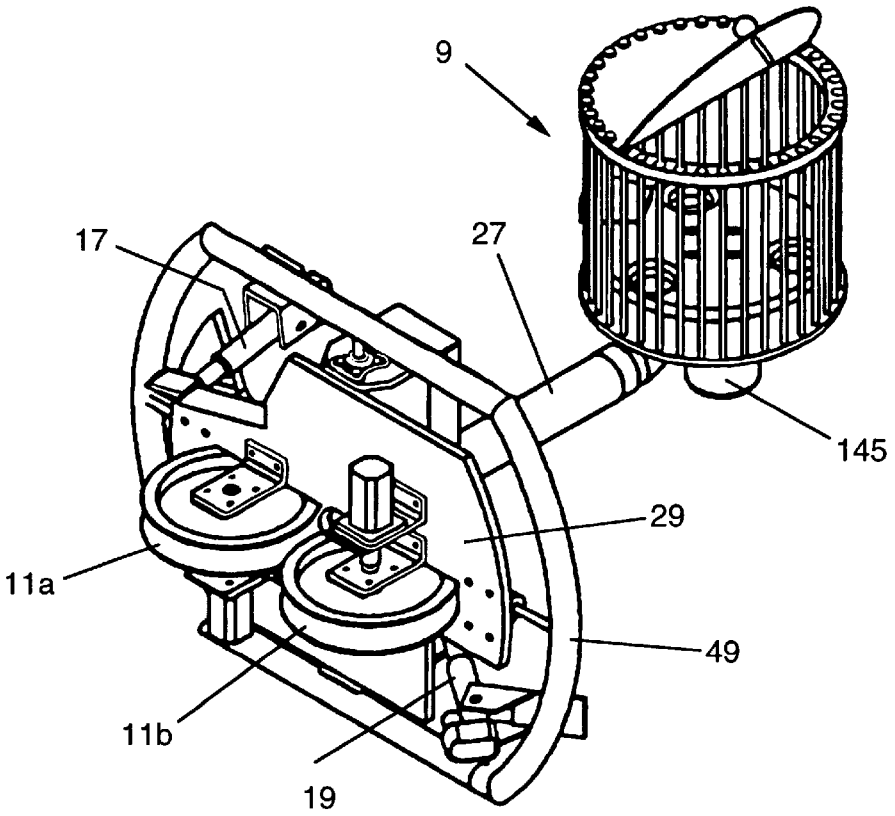
FIG. 10A is a perspective view of a ball magazine attached to a pitching head assembly according to a preferred form of the invention.
Figure 10B:
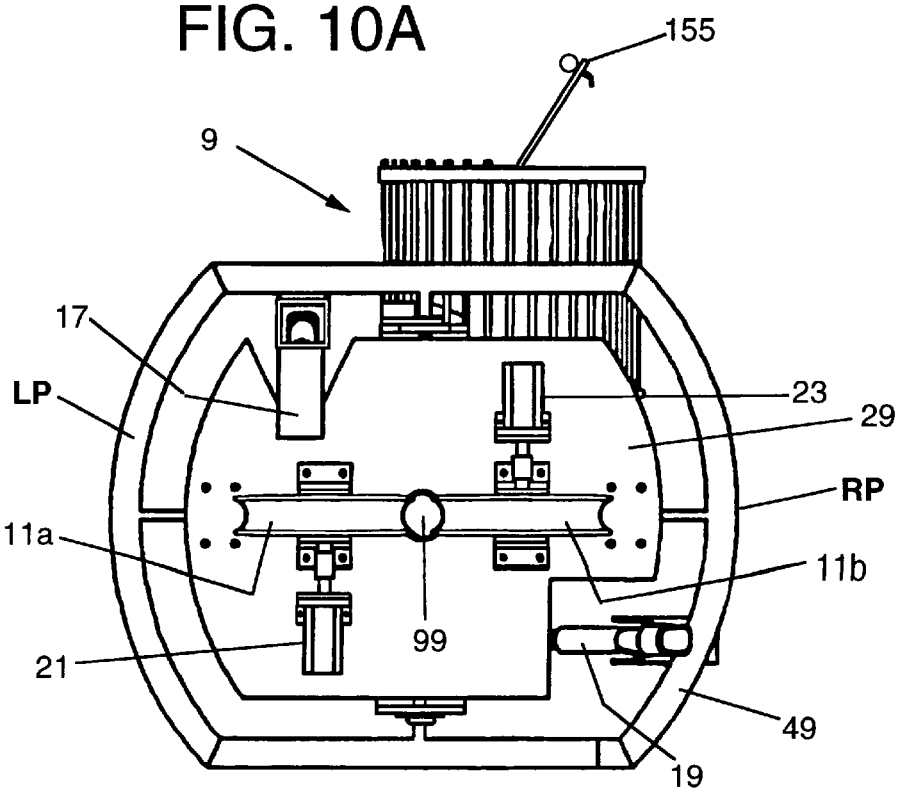
FIG. 10B is a frontal view of a ball magazine attached to a pitching head assembly according to a preferred form of the invention.
Figure 10C:
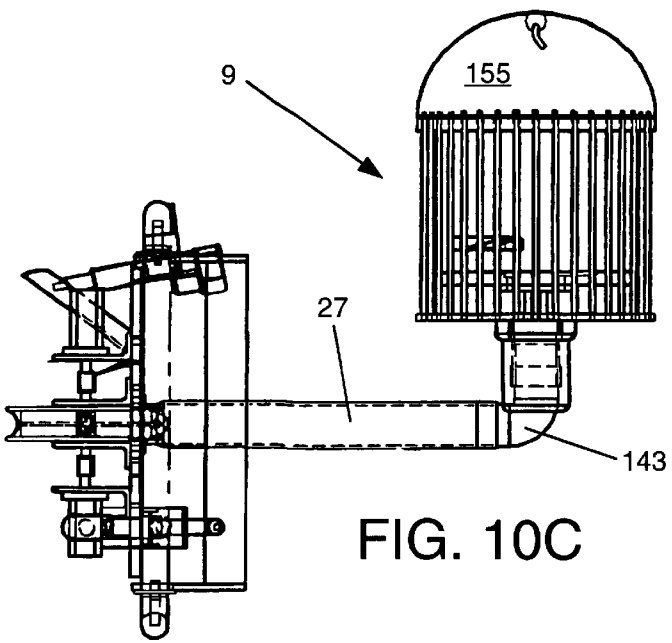
FIG. 10C is a side view of a ball magazine attached to a pitching head assembly according to a preferred form of the invention.

In FIG. 10A a ball magazine attached to a pitching head assembly according to a preferred form of the invention is shown, depicting the respective positions of the elements and showing the ball magazine 9, ball feed conduit 27, motor 145, head assembly plate 29, head assembly bar 49, actuators 17 and 19, and velocitizing means 11*a* and 11*b*. FIG. 10B is a frontal view of a ball magazine attached to a pitching head assembly according to a preferred form of the invention showing those elements afore described in this different perspective for clarity, and FIG. 10C is a side view of a ball magazine attached to a pitching head assembly according to a preferred form of the invention.

Although the aforesaid represents a preferred ball magazine configuration, other methods for delivering a ball to the ball delivery conduit are useful within the scope of this invention, including other ball magazines known in the art, as well as manually feeding a ball into the delivery conduit.

It is preferred that the ball feed conduit 27 is substantially linear, and comprises a first terminal end and a second terminal end. It is preferred that the ball feed conduit is disposed through the hole in the head assembly beam and through the hole through the pitching head support beam. Preferably, the first terminal end of the ball feed conduit is located within effective sufficient proximity of the ball delivery hole to provide for communicating the ball delivered from the magazine to come into contact with the velocitizing means. Preferably, the first terminal end of the ball feed conduit is located within about 1 inch of the ball delivery hole. The second terminal end of the ball feed conduit protrudes from the opposite side of the pitching head support beam that the head assembly beam is located, and it is to the second terminal end that a ball magazine according to a preferred form of the invention is connected.

Figure 11A:
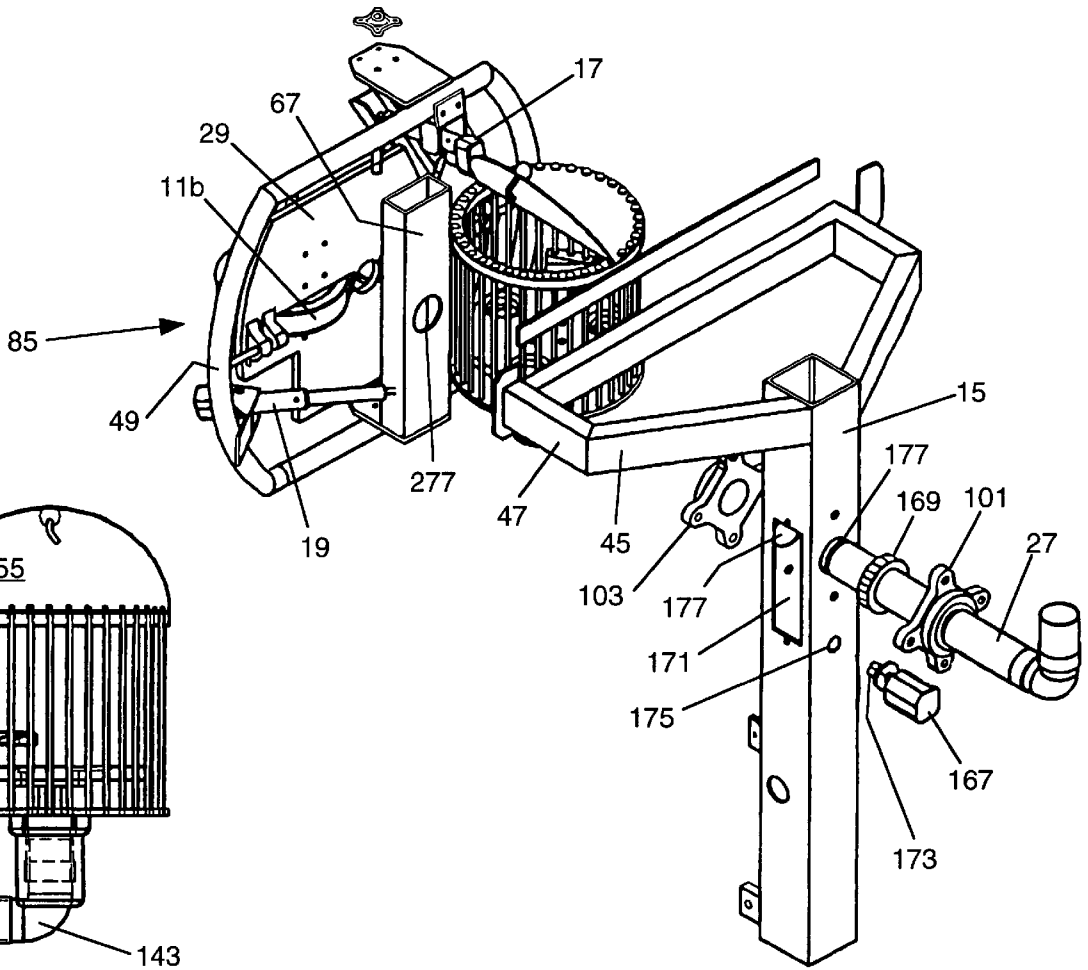
FIG. 11A is a rear perspective view of the locations of various elements of the invention, including the way that the ball conduit tube is disposed through the pitching head support beam in one preferred form of the invention.

FIG. 11A is a rear perspective view of the locations of various elements of the invention, including the way that the ball conduit tube is disposed through the pitching head support beam in one preferred form of the invention. In this figure is depicted the combination motor 167 and driver gear 173 such as that manufactured by Oriental Motor of Torrance, Calif. under model number FBL5120A-100, which however may be either an AC or DC motor, which motor causes the pitching head assembly as a whole to be rotated about the "z" axis of FIG. 1 upon its energization by virtue of its shaft being fitted with a driver gear 173 that matches the collar gear 169 that is in mechanical contact with the outer surface of the ball feed conduit 27. There is a belt means (not shown) which connects the driver gear 173 on the shaft of motor 167 with the collar gear 169 and which may optionally be a chain or other means known to those skilled in the art for communicating the output from the shaft of a motor. It is most preferable that the collar gear 169 is disposed about the outer surface of the ball feed conduit in a location within the interior hollow confines of head assembly support beam 67, to avoid exposure of the belt to ambient conditions. In such case, the gear 173 on the output shaft of the motor is also preferably disposed within the hollow portion of the head assembly support beam 67 as well, and such is readily accomplished by a mounting of the motor shaft through a hole 175 conveniently located through a portion of the head assembly support beam 67 and affixing the gear 173 about the shaft after the insertion of the shaft. In such instance, the motor is mounted to the outer surface of the head assembly support beam 67.

Conveniently, the ball feed conduit is rotably disposed through a hole 177 entirely through the pitching head support beam 15, in a preferred form of the invention, by virtue of bearings 101 and 103 disposed about the ball feed conduit 27. This is an essential element for enabling the head assembly support beam 67 (and hence the entire pitching head assembly 85), to be rotably disposed about the axis of the ball feed conduit 27 with respect to the pitching head support beam 15, and controllably so, by employing selectively energizable motor means 167 and the aforementioned gears and motor.

The head assembly support beam 67 is preferably of a hollow rectangular construction and includes hole 277 through which the ball conduit may pass. The head assembly support beam also has connective bearings 71 and 72 connected to its first and second end portions to which the head assembly bar is also attached. Thus, the head assembly bar 49 is seen to be an integral portion of the pitching head assembly 85, as it is pivotally connected to the head assembly support beam 67 by these connective bearings 71 and 72. The head assembly support beam 67 is also connected to the head assembly bar by means of the actuator 19. FIG. 11A also shows a preferred location of the ball magazine 9.

Figure 11C:
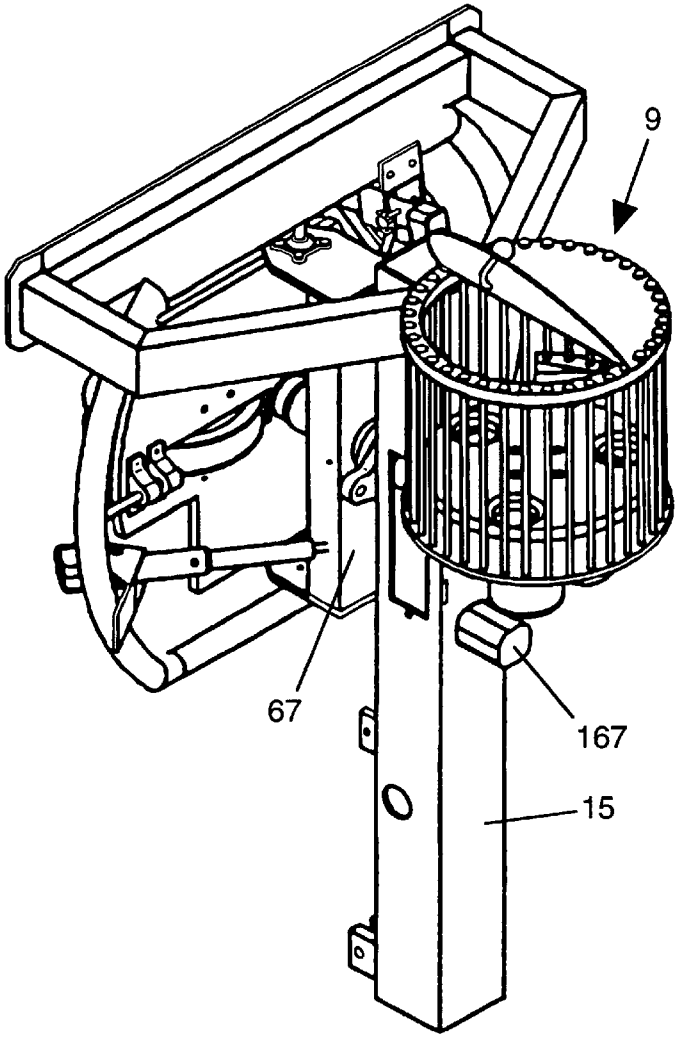
FIG. 11C is a rear perspective view of a pitching head assembly, ball magazine, pitching head support beam and message marquis of a pitching machine made in accordance with a preferred form of the invention.
Figure 11B:
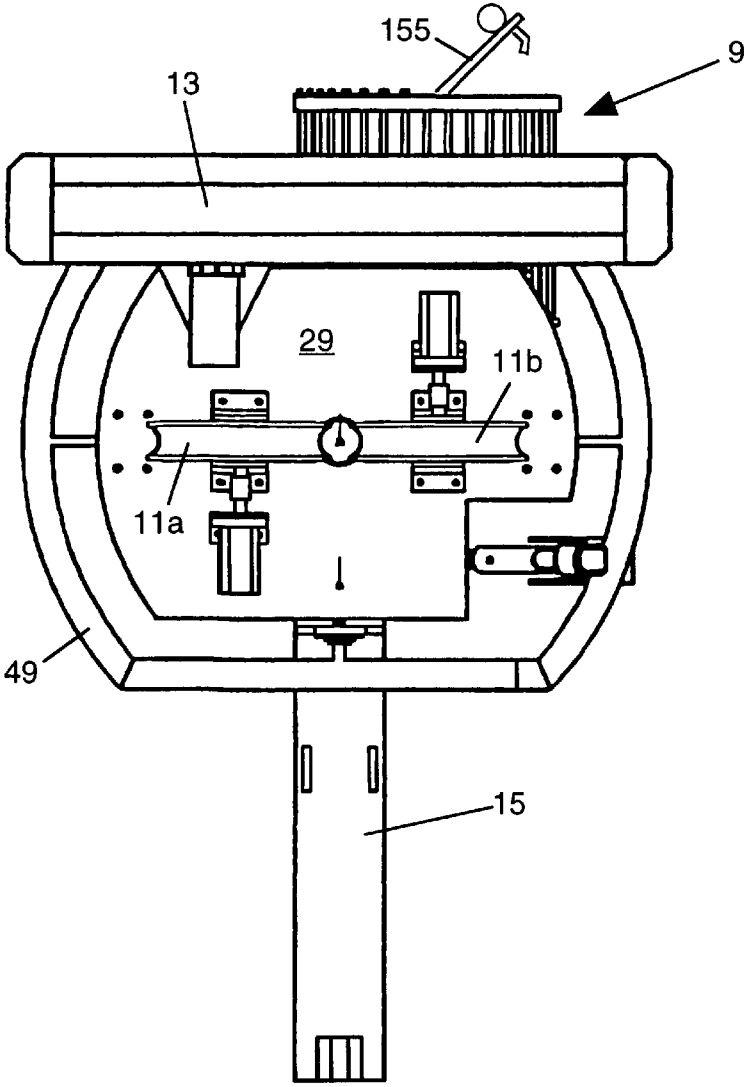
FIG. 11B is a front view of a pitching head assembly, ball magazine, and message marquis of a pitching machine made in accordance with a preferred form of the invention.

FIG. 11B is a front view of a pitching head assembly, ball magazine, and message marquis of a pitching machine made in accordance with a preferred form of the invention showing a frontal perspective of a device according to a preferred form of the invention.

FIG. 11C is a rear perspective view of a pitching head assembly, ball magazine, pitching head support beam and message marquis of a pitching machine made in accordance with a preferred form of the invention, depicting the various elements set forth in FIG. 11A in their respective locations in a final assembled version of the pitching head assembly disposed about the head assembly support beam 67.

As mentioned, there are various actuators and electrical motors which are part of the invention described. It is through control of these motors and actuators, either alone or in combination with one another, that the magnitude and direction of a ball projected by the device may be effectively controlled to provide a myriad of possible flight characteristics. For example, the magnitude of the rotational speed of the velocitizing means directly affects the speed of the pitched ball. Use of identical rotational speeds of both of the velocitizing means on the order of 2240 revolutions per minute will deliver a regulation hardball baseball at a speed of 80 miles per hour from a device according to the invention, as ejected. By slowing one of the velocitizing means to an rpm of about 2100 while keeping the other at 2240 rpm, a spin is conferred to the ball which makes it tend towards the direction of the slower spinning velocitizing means. By causing rotation of the pitching head assembly 85, such as by energizing motor 167, the direction of such spin can be altered to any angle desired. Further, by actuating the actuators 17 or 19 or both, the plane of the head assembly plate can be angled right, left, up, and down with respect to a batter standing 60 feet in front of the device. Such an attitude, coupled with a left velocitizing means that spins slower than the right velocitizing means, would provide a pitch that is initially directed at a point outside the "batters box", but which curves inward after travelling some distance owing to the curvature so conferred. By energizing the motor 167, similar curvature may be directed downwards, upwards, or at some point therebetween.

With the advent of modem electronics, it is now possible to utilize various industrial electronic controls to control actuators and motors such as those used in the present invention. It is common for such electronic controls to comprise substantial amounts of memory, into which may be programmed various pre-selected operating characteristics. One suitable electronics control means is that manufactured by Allen-Bradley of Milwaukee, Wis. under model number 1771. The use of such controller is within the level of skill of the artisan of ordinary skill, for all which is required is that a power supply is connected to the controller, which then distributes electrical energy in response to its programming to the motors and actuators of the invention. Since controlled energization of electrical motors is well known in the art, it is not difficult to use such a programmable controller to consistently deliver pitches of the same flight characteristics using the pitching device of the invention.

Although various elements of the invention have been described herein as functioning together, it is within the scope of the present invention to employ elements from other devices in the stead of those mentioned herein. For example, the pitching head support beam 15 is described herein as comprising the pitching head assembly 85 disposed at or near its top portion, and the pitching head support beam was described as being collapsible for convenient transportation and storage. The present invention contemplates the use of other elements, such as an element of the prior art analogous to the pitching head assembly in overall function insomuch as its general ability to deliver a projectile is concerned, i.e., a pitching head assembly other than that taught by this invention may be affixed at or near the top portion of the pitching head support beam to provide a device having convenient transportation and characteristics similar to those of the present invention. Alternatively, the pitching head assembly of this invention could be affixed to a stationary vertical beam, i.e., not a collapsible arrangement as described herein, but merely a beam or pole in the ground. Such arrangement provides for a permanent fixture having the same utility as the device described herein.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Such modifications may include without limitation changing the size of the various components of the invention to accommodate projectiles of various diameters, or materials of construction. Accordingly, the presently disclosed invention is intended to cover all such modifications and alterations, and is limited only by the scope of the claims which follow.

What is claimed is:

1. A device useful for pitching spherical projectiles including baseballs and the like which comprises:

a) a vertically oriented pitching head support beam, having an uppermost end, a lowermost end, a hollow interior portion, and a first hole disposed through said pitching head support beam in a direction perpendicular to its length dimension;

b) a pitching head assembly attached to the pitching head support beam between its uppermost end and its lowermost end, wherein said pitching head assembly comprises:

i) a substantially linear head assembly beam having a first end portion, a second end portion, a hollow interior portion, a first and a second connective bearing support arm disposed at each of its first and second end portions, and a second hole disposed through its hollow interior portion in a direction perpendicular to its length dimension;

ii) a head assembly bar portion having parallel top and a bottom edge portions that are joined together at their ends by a left portion and a right portion, wherein each of the top and bottom edge portions of said head assembly bar are pivotally attached to the connective bearing support arms disposed on the head assembly beam;

iii) a head assembly plate portion that comprises a top portion, a bottom portion, a left side portion and a right side portion, and having a ball delivery hole disposed through its surface, wherein said plate portion is pivotally attached at its left side portion to the left portion of the head assembly bar portion and pivotally attached at its right side portion to the right portion of the head assembly bar portion, said head assembly plate further comprising a first and a second circular velocitizing means that are each rotably disposed within bearing means that are sufficiently attached to said plate portion to enable rotation of said velocitizing means about an axis that is skew to the centerline of said ball delivery hole, and to permit the outer surfaces of said first and second circular velocitizing means to be in sufficient proximity to said ball delivery hole to enable contact between said outer surfaces and a ball which has emerged from said hole a distance equal to the diameter of said ball delivery hole;

c) a linear conduit having a first and a second end, by which said linear conduit the pitching head assembly is caused to be rotably attached to the pitching head support beam, wherein said conduit passes through each of said first and second holes such that the conduit and said first and second holes all share a common centerline, said conduit comprising an outer surface with a bearing means connectively disposed coextensively about said outer surface, wherein the bearing means is also in mechanical contact with said pitching head support beam, by which bearing means the head assembly beam is caused to be rotably connected to said pitching head support beam; and d) motive means for conferring rotational motion to said velocitizing means, wherein the first end of said conduit is disposed in sufficient proximity with said ball delivery hole of said plate portion to permit delivery of a spherical projectile that is fed into the second end of said conduit to said hole.

2. A device according to claim 1 further comprising a means for delivering a spherical projectile to said second end of said conduit.

3. A device according to claim 2 wherein said means for delivering includes a magazine means.

4. A device according to claim 2 wherein said second end of said conduit is adapted to receive a ball that is manually fed to said second end of said conduit.

5. A device according to claim 1 further comprising:

e) an actuator means having a first and a second end portion wherein said first end portion is connected to said head assembly beam and wherein said second end portion is connected to a head assembly bar element selected from the group consisting of: the left portion of the head assembly bar or the right portion of the head assembly bar.

6. A device according to claim 1 further comprising:

e) an actuator means having a first and a second end portion wherein said first end portion is connected to said head assembly plate and wherein said second end portion is connected to a head assembly bar element selected from the group consisting of: the top edge portion of the head assembly bar or the bottom edge portion of the head assembly bar.

7. A device according to claim 1 further comprising:

e) a first actuator means having a first and a second end portion wherein said first end portion of said first actuator means is connected to said head assembly beam and wherein said second end portion of said first actuator means is connected to a head assembly bar element selected from the group consisting of: the left portion of the head assembly bar or the right portion of the head assembly bar; and f) a second actuator means having a first and a second end portion wherein said first end portion of said second actuator means is connected to said head assembly plate and wherein said second end portion of said second actuator means is connected to a head assembly bar element selected from the group consisting of: the top edge portion of the head assembly bar or the bottom edge portion of the head assembly bar.

8. A device according to claim 1 further comprising:

e) an actuator means having a first and a second end portion wherein said first end portion is connected to said head assembly beam and wherein said second end portion is connected to the right portion of the head assembly bar.

9. A device according to claim 1 further comprising:

e) an actuator means having a first and a second end portion wherein said first end portion is connected to the top portion of the head assembly plate and wherein said second end portion is connected to the top edge portion of the head assembly bar.

10. A device according to claim 1 wherein said motive means comprises a motor selected from the group consisting of DC motors or AC motors.

11. A device according to claim 1 further comprising:

e) a ring gear disposed about said conduit at a location within the hollow portion of said pitching head support beam;

f) a rotational drive motor having a drive gear disposed about its output shaft, wherein said drive gear is disposed within the hollow portion of said pitching head support beam; and g) a drive means in contact with said ring gear and said drive gear sufficient to transfer motive energy from said rotational drive motor to said ring gear.

12. A device according to claim 1 wherein said velocitizing means rotate at any velocity between 500 rotations per minute and 5000 rotations per minute, including every degree of rotation therebetween.

13. A device according to claim 1 wherein said velocitizing means have any diameter between 2.00 inches and 40.00 inches, including every hundredth inch therebetween.

14. A device according to claim 1 wherein the velocitizing means rotate at different velocities.

15. A device according to claim 1 wherein the velocitizing means are disposed in a side-by-side configuration.

16. A device according to claim 1 wherein the velocitizing means are disposed in an over-and-under configuration.

17. A device according to claim 1 wherein the energization of the motive means is microprocessor controlled.

18. The process of providing motion to a spherical projectile comprising the steps of:

a) providing a device according to claim 1;

b) causing said velocitizing means to rotate at any selected speed; and c) causing a spherical projectile to pass through said ball delivery hole and to be contacted by both of said velocitizing means.

19. The process according to claim 18 wherein said velocitizing means rotate at different speeds.

20. The process according to claim 19 wherein said velocitizing means rotate at the same speed.

21. A device useful for pitching spherical projectiles including baseballs and the like which comprises:

a) a vertically oriented pitching head support beam, having an uppermost end, a lowermost end, a hollow interior portion, and a first hole disposed through said pitching head support beam in a direction perpendicular to its length dimension;

b) a pitching head assembly attached to the pitching head support beam between its uppermost end and its lowermost end, wherein said pitching head assembly comprises:

i) a substantially linear head assembly beam having a first end portion, a second end portion, a hollow interior portion, a first and a second connective bearing support arm disposed at each of its first and second end portions, and a second hole disposed through its hollow interior portion in a direction perpendicular to its length dimension;

ii) a head assembly bar portion having parallel top and a bottom edge portions that are joined together at their ends by a left portion and a right portion, wherein each of the top and bottom edge portions of said head assembly bar are pivotally attached to the connective bearing support arms disposed on the head assembly beam;

iii) a head assembly plate portion that comprises a top portion, a bottom portion, a left side portion and a right side portion, and having a ball delivery hole disposed through its surface, wherein said plate portion is pivotally attached at its left side portion to the left portion of the head assembly bar portion and pivotally attached at its right side portion to the right portion of the head assembly bar portion, said head assembly plate further comprising a first and a second circular velocitizing means that are each rotably disposed within bearing means that are sufficiently attached to said plate portion to enable rotation of said velocitizing means about an axis that is skew to the centerline of said ball delivery hole, and to permit the outer surfaces of said first and second circular velocitizing means to be in sufficient proximity to said ball delivery hole to enable contact between said outer surfaces and a ball which has emerged from said hole a distance equal to the diameter of said ball delivery hole;

c) a linear conduit having a first and a second end, by which said linear conduit the pitching head assembly is caused to be rotably attached to the pitching head support beam, wherein said conduit passes through each of said first and second holes such that the conduit and said first and second holes all share a common centerline, said conduit comprising an outer surface with a bearing means connectively disposed coextensively about said outer surface, wherein the bearing means is also in mechanical contact with said pitching head support beam, by which bearing means the head assembly beam is caused to be rotably connected to said pitching head support beam; and d) motive means for conferring rotational motion to said velocitizing means, wherein the first end of said conduit is disposed in sufficient proximity with said ball delivery hole of said plate portion to permit delivery of a spherical projectile that is fed into the second end of said conduit to said hole;

e) a first actuator means having a first and a second end portion wherein said first end portion of said first actuator means is connected to said head assembly beam and wherein said second end portion of said first actuator means is connected to the right portion of the head assembly bar; and f) a second actuator means having a first and a second end portion wherein said first end portion of said second actuator means is connected to the top portion of the head assembly plate and wherein said second end portion of said second actuator means is connected to the top edge portion of the head assembly bar.

22. A device according to claim 21 further comprising:

g) a wheeled frame portion, wherein the lowermost end of the pitching head support beam is connected to said frame portion.

23. A device according to claim 21 further comprising:

g) a substantially planar frame portion having a vertical beam portion extending upwardly from the plane of said frame portion, said vertical beam portion having an uppermost portion and a lowermost portion, wherein the lowermost portion is connected to said frame portion, and wherein the pitching head support beam is pivotally connected to the uppermost portion of said vertical beam portion at a pivot point.

24. A device according to claim 23 further comprising:

h) a third actuator means having a first end portion and a second end portion wherein the first end portion of the third actuator means is connected to the frame portion, and the second end portion of the third actuator means is connected to the pitching head support beam at a point between its lowermost end and the location of the pivot point.

25. A device according to claim 24 wherein the actuators are selected from the group consisting of: electrically operated actuators or hydraulically operated actuators.

26. A device according to claim 24 wherein said frame portion comprises retractable wheels.

27. A device according to claim 26 wherein actuation of said actuator causes said retractable wheels to be in a retracted position simultaneous to the pivoting of said pitching head support beam into a vertical position.

28. A device according to claim 26 wherein the retractable wheels are retracted when the pitching head support beam is in a vertical position.

29. A device according to claim 26 wherein the retractable wheels are extended when the pitching head support beam is in a horizontal position.

30. A device according to claim 21 wherein said velocitizing means rotate at any velocity between 500 rotations per minute and 5000 rotations per minute, including every degree of rotation therebetween.

31. A device according to claim 21 wherein said velocitizing means have any diameter between 2.00 inches and 40.00 inches, including every hundredth inch therebetween.

32. A device according to claim 21 wherein the velocitizing means rotate at different velocities.

33. A device according to claim 21 wherein the velocitizing means are disposed in a side-by-side configuration.

34. A device according to claim 21 wherein the velocitizing means are disposed in an over-and-under configuration.

35. A device according to claim 21 wherein the energization of the motive means is microprocessor controlled.

36. A device according to claim 21 wherein the energization of the motive means is microprocessor controlled.

37. A device according to claim 21 further comprising:

g) a ring gear disposed about said conduit at a location within the hollow portion of said pitching head support beam;

h) a rotational drive motor having a drive gear disposed about its output shaft, wherein said drive gear is disposed within the hollow portion of said pitching head support beam; and i) a drive means in contact with said ring gear and said drive gear sufficient to transfer motive energy from said rotational drive motor to said ring gear.

38. A device according to claim 37 wherein the energization of the motive means is microprocessor controlled.

39. A device according to claim 37 wherein the energization of the motive means and said rotational drive motor are microprocessor controlled.

40. The process of providing motion to a spherical projectile comprising the steps of:

a) providing a device according to claim 21;

b) causing said velocitizing means to rotate at any selected speed; and c) causing a spherical projectile to pass through said ball delivery hole and to be contacted by said velocitizing means.

41. The process according to claim 40 wherein said velocitizing means rotate at different speeds.

42. The process according to claim 40 wherein said velocitizing means rotate at the same speed.

43. A device for projecting spherical objects which comprises a head assembly plate portion that comprises a top portion, a bottom portion, a left side portion and a right side portion, and having a ball delivery hole disposed through its surface, said head assembly plate further comprising a first and a second circular velocitizing means that are each rotably disposed within bearing means that are sufficiently attached to said plate portion to enable rotation of said velocitizing means about an axis that is skew to the centerline of said ball delivery hole, and to permit the outer surfaces of said first and second circular velocitizing means to be in sufficient proximity to said ball delivery hole to enable contact between said outer surfaces and a ball which has emerged from said hole a distance equal to the diameter of said ball delivery hole.

44. A device according to claim 43 further comprising a head assembly beam, wherein said plate portion is attached to said head assembly beam by means of connective bearings.

45. A device according to claim 44 further comprising a pitching head support beam wherein said head assembly beam is rotably attached to said pitching head support beam such that the axis of rotation of said plate portion coincides with the centerline of said ball delivery hole.

46. A device according to claim 45 further comprising a frame portion having a vertical beam portion, wherein said pitching head support beam is pivotally connected to said vertical beam portion so as to enable said vertical beam portion to assume a vertical position, a horizontal position, or any position therebetween.

47. A device according to claim 46 wherein said frame portion comprises a retractable wheel, wherein said wheel is caused to be in a retracted position when said pitching head support beam portion is in a vertical position.

* * * * *